US009977361B2

(12) United States Patent
Kanaya et al.

(10) Patent No.: US 9,977,361 B2
(45) Date of Patent: May 22, 2018

(54) IMAGE FORMING APPARATUS AND IMAGE FORMING SYSTEM

(71) Applicants: Hideaki Kanaya, Tokyo (JP); Taichi Urayama, Kanagawa (JP); Ryusuke Mase, Kanagawa (JP); Hiroki Ishii, Kanagawa (JP); Hiroyuki Sugiyama, Kanagawa (JP); Saki Izumi, Ehime (JP); Yuushi Hirayama, Shizuoka (JP)

(72) Inventors: Hideaki Kanaya, Tokyo (JP); Taichi Urayama, Kanagawa (JP); Ryusuke Mase, Kanagawa (JP); Hiroki Ishii, Kanagawa (JP); Hiroyuki Sugiyama, Kanagawa (JP); Saki Izumi, Ehime (JP); Yuushi Hirayama, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/354,401

(22) Filed: Nov. 17, 2016

(65) Prior Publication Data

US 2017/0153564 A1 Jun. 1, 2017

(30) Foreign Application Priority Data

Nov. 30, 2015 (JP) ..... 2015-233586
Dec. 11, 2015 (JP) ..... 2015-242093

(51) Int. Cl.
*G03G 15/02* (2006.01)
*G03G 15/00* (2006.01)
*G03G 21/20* (2006.01)

(52) U.S. Cl.
CPC ..... *G03G 15/0266* (2013.01); *G03G 15/5058* (2013.01); *G03G 21/20* (2013.01)

(58) Field of Classification Search
None
See application file for complete search history.

(56) References Cited

U.S. PATENT DOCUMENTS

2005/0207766 A1 9/2005 Hasegawa et al.
2007/0122168 A1 5/2007 Tanaka et al.
(Continued)

FOREIGN PATENT DOCUMENTS

JP 2008-083461 4/2008
JP 2015-087563 5/2015

OTHER PUBLICATIONS

U.S. Appl. No. 15/155,317, filed May 16, 2016.

*Primary Examiner* — Thomas Giampaolo, II
(74) *Attorney, Agent, or Firm* — Oblon, McClelland, Maier & Neustadt, L.L.P.

(57) ABSTRACT

An image forming apparatus includes an image bearer, a charging, a charge power supply to supply a charging bias to the charging device, a developing device, a toner adhesion amount detector, an environment detector, and a controller to determine whether to execute a charging bias adjustment process in which the charging device charges the image bearer to have different potentials, the developing device supplies the toner to the image bearer according to the different potentials, the toner adhesion amount detector detects the amount of toner adhering to the image bearer, and the controller adjusts the charging. The controller includes a memory device to store the environment data, and is configured to compare the environment data with previous environment data stored in the memory device, and determine not to execute the charging bias adjustment process when an environment change amount is not greater than a threshold.

9 Claims, 19 Drawing Sheets

(56) References Cited

U.S. PATENT DOCUMENTS

| | | | | |
|---|---|---|---|---|
| 2007/0122171 | A1 | 5/2007 | Fujimori et al. | |
| 2007/0230979 | A1 | 10/2007 | Hasegawa et al. | |
| 2009/0110413 | A1 | 4/2009 | Takeuchi et al. | |
| 2009/0263150 | A1 | 10/2009 | Fujimori et al. | |
| 2009/0324267 | A1 | 12/2009 | Yoshida et al. | |
| 2011/0069977 | A1* | 3/2011 | Yasukawa | G03G 15/556 399/27 |
| 2014/0348521 | A1 | 11/2014 | Mase et al. | |
| 2015/0117884 | A1 | 4/2015 | Sugiyama et al. | |
| 2015/0139668 | A1 | 5/2015 | Sugiyama et al. | |
| 2015/0139674 | A1 | 5/2015 | Sugiyama et al. | |
| 2016/0252838 | A1* | 9/2016 | Kato | G03G 15/0266 399/50 |
| 2017/0097584 | A1* | 4/2017 | Wada | G03G 15/0266 |

* cited by examiner

IMAGE FORMING APPARATUS AND IMAGE FORMING SYSTEM

CROSS-REFERENCE TO RELATED APPLICATIONS

This patent application is based on and claims priority pursuant to 35 U.S.C. § 119(a) to Japanese Patent Application Nos. 2015-233586, filed on Nov. 30, 2015, and 2015-242093, filed on Dec. 11, 2015, in the Japan Patent Office, the entire disclosure of each of which is hereby incorporated by reference herein.

BACKGROUND

Technical Field

Embodiments of the present invention generally relate to an image forming apparatus, such as a copier, a printer, a facsimile machine, or a multifunction peripheral (MFP) having at least two of copying, printing, facsimile transmission, plotting, and scanning capabilities, and an image forming system including a plurality of image forming apparatuses and a management device capable of communicating therewith.

Description of the Related Art

There are image forming apparatuses that form a background fog (i.e., background stain) pattern on a surface of a latent image bearer (e.g., a photoconductor), detect the amount of toner adhering to the background fog pattern, and adjusts a value of charging bias output from a charge power supply based on the detected amount of toner adhering, which is called "charging bias adjustment".

For example, the following control operation is executed under a situation in which the accumulative running distance of the photoconductor from the previous charging bias adjustment operation is greater than or equal to a threshold, and the current environment (temperature, humidity, or both) is out of a preferable environment. While rotating the photoconductor, the charging bias supplied to a charging device to charge the photoconductor is changed stepwise. As sections of the photoconductor, charged under different charging bias conditions, sequentially pass a developing range opposing a developing device, a background fog pattern is formed on the surface of the photoconductor. Based on results of detection by a toner adhesion amount detector detecting the amount of toner adhering to each section (different in charging bias condition) of the background fog pattern, the relation between the charging bias value and the amount of background fog is identified. Based on the identified relation, the charging bias is adjusted not to cause background fog.

SUMMARY

An embodiment of the present invention provides an image forming apparatus that includes an image bearer, a charging device to charge the image bearer, a charge power supply to supply a charging bias to the charging device, a developing device to supply toner to the image bearer according to a charging potential of the image bearer, a toner adhesion amount detector to detect an amount of toner adhering to the image bearer, an environment detector to generate environment data, and a controller to determine whether to execute a charging bias adjustment process. In the charging bias adjustment process, the charging device charges the image bearer to have different potentials, the developing device supplies the toner to the image bearer according to the different potentials, the toner adhesion amount detector detects the amount of toner adhering to the image bearer, and the controller adjusts the charging bias supplied from the charge power supply. Further, the controller includes a memory device to store previous environment data generated in a previous charging bias adjustment process. Further, the controller is configured to compare the environment data generated by the environment detector with the stored environment data, and determine not to execute the charging bias adjustment process when an environment change amount is not greater than a threshold.

Another embodiment provide an image forming system that includes a plurality of image forming apparatuses and a management device including a memory device and configured to communicate with the plurality of image forming apparatuses. Each of the plurality of image forming apparatuses is configured as described above.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
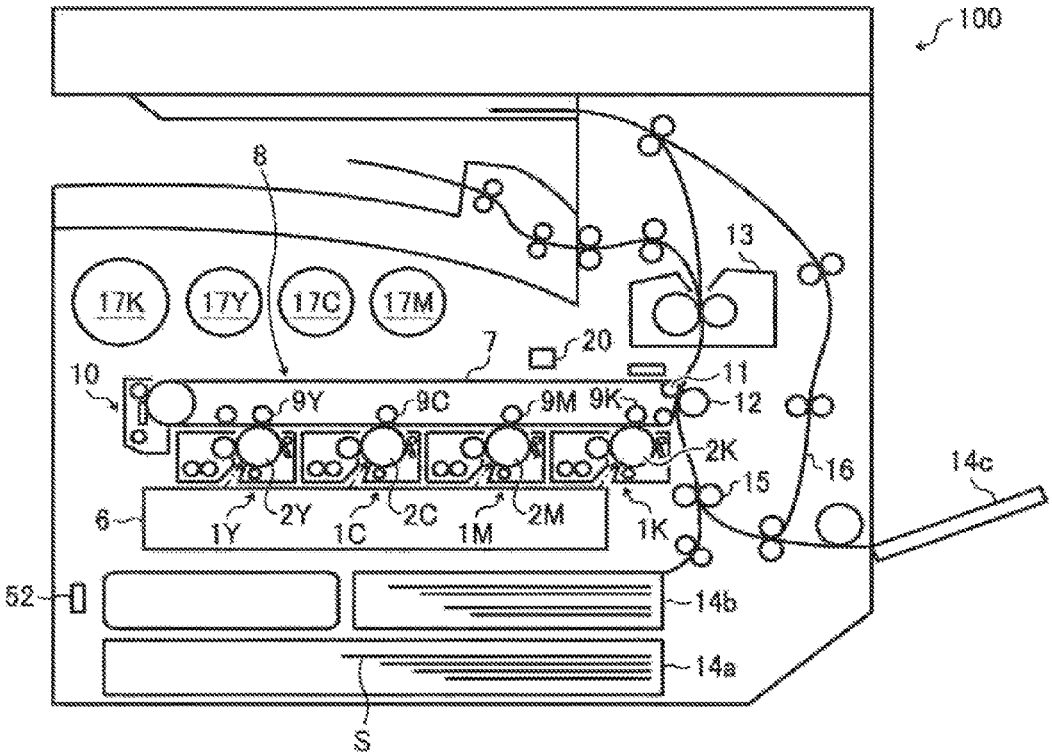
FIG. 1 is a schematic diagram of an image forming apparatus according to an embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

The downtime of the image forming apparatus, however, increases if the charging bias adjustment is executed unnecessarily. Specifically, the current setting of charging bias is often proper in a case where changes in environment from the previous charging bias adjustment operation are small even in a situation that the accumulative running distance of the photoconductor from the previous charging bias adjustment operation is greater than or equal to the threshold and the current environment is out of a preferable environment.

Referring now to the drawings, wherein like reference numerals designate identical or corresponding parts throughout the several views thereof, and particularly to FIG. 1, an electrophotographic image forming apparatus according to an embodiment of the present invention is described. For example, the image forming apparatus is a printer. As used herein, the singular forms "a", "an", and "the" are intended to include the plural forms as well, unless the context clearly indicates otherwise.

FIG. 1 is a schematic diagram illustrating a basic configuration of a printer 100 as an example of the image forming apparatus according to the present embodiment.

The printer 100 includes four image forming units 1Y, 1C, 1M, and 1K (also collectively "image forming units 1") for forming yellow (Y), cyan (C), magenta (M), and black (K) images. It is to be noted that reference characters Y, C, M, and K represent yellow, cyan, magenta, and black, respectively, and may be omitted in the description below when color discrimination is not necessary. The arrangement order of Y, C, M, and K is not limited to the order illustrated in FIG. 1.

Figure 2:
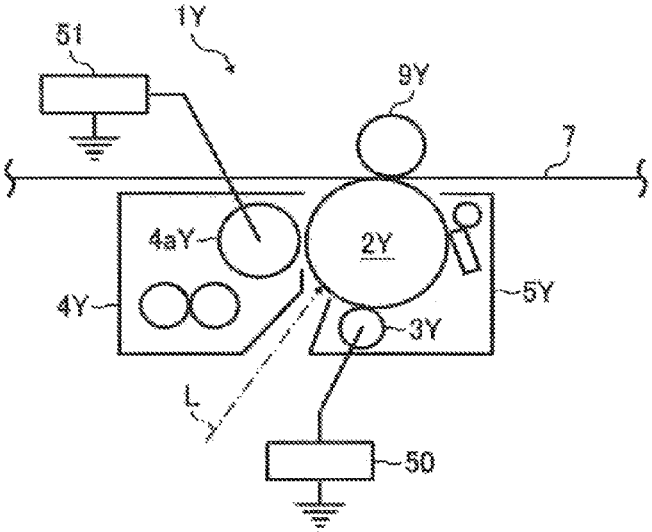
FIG. 2 is an end-on axial view illustrating a main part of an image forming unit of the image forming apparatus illustrated in FIG. 1.

FIG. 2 illustrates a configuration of an image forming unit of the printer according to the present embodiment. As illustrated in FIG. 2, the image forming unit 1Y includes a drum-shaped photoconductor 2Y serving as a latent image bearer, and a charging roller 3Y serving as a charger, a developing device 4Y, and a cleaning device 5Y are disposed around the photoconductor 2Y. The charging roller 3Y is, for example, a rubber roller and configured to rotate while contacting the surface of the photoconductor 2Y. The printer 100 according to the present embodiment employs contact-type DC (direct current) charging, and a charging bias applied to the charging roller 3Y is a DC bias without an AC (alternating current) component. Alternatively, a contact-type charging roller or a contactless charging roller can be adopted as the charging roller 3Y.

The developing device 4Y contains two-component developer including magnetic carrier (carrier particles) and toner (toner particles). The two-component developer used in the present embodiment includes toner having an average particle diameter ranging from 4.9 μm to 5.5 μm and carrier having a small diameter and a low resistivity. The carrier has a bridge resistivity of 12.1 Log Ω·cm or lower. The developing device 4Y includes a developing roller 4*a*Y disposed facing the photoconductor 2Y, a screw to transport and stir the developer, and a toner concentration sensor. The developing roller 4*a*Y includes a rotatable, hollow developing sleeve and a magnet roller disposed inside the developing sleeve. The magnet roller is configured not to rotate together with the developing sleeve.

The image forming unit 1Y is configured as a process cartridge, and the photoconductor 2Y and the components disposed therearound, namely, the charging roller 3Y, the developing device 4Y, and the cleaning device 5Y are supported by a common frame (a supporter). The image forming unit 1Y is removably installable in an apparatus body of the printer 100. Thus, multiple consumables are replaced at a time when the operational lives thereof expire. The other image forming units 1C, 1M, and 1K are similar in configuration to the image forming unit 1Y, differing only in the color of toner employed.

Below the image forming units 1Y, 1C, 1M, and 1K, an optical writing unit 6 serving as a latent-image writing device to write a latent image on the photoconductors 2Y, 2C, 2M, and 2K (collectively "photoconductors 2") is disposed. The optical writing unit 6 includes a light source, a polygon mirror, an f-O lens, and reflection mirrors and is configured to direct laser beams L onto the surfaces of the photoconductors 2Y, 2C, 2M, and 2K according to image data. Accordingly, the electrostatic latent images of yellow, cyan, magenta, and black are formed on the photoconductors 2Y, 2M, 2C, and 2K, respectively. The electrostatic latent images are precursors of digital images made of multiple dots or dot pattern.

An intermediate transfer unit 8 disposed above the image forming units 1Y, 1C, 1M, and 1K transfers toner images of respective colors from the photoconductors 2Y, 2C, 2M, and 2K via an intermediate transfer belt 7 onto a recording sheet S (i.e., a recording medium). The intermediate transfer belt 7 is entrained around a plurality of rollers and rotated counterclockwise in FIG. 1 as at least one of the plurality of rollers rotates. The intermediate transfer unit 8 includes the intermediate transfer belt 7, primary transfer rollers 9Y, 9C, 9M, and 9K, a belt cleaning device 10, a secondary-transfer backup roller 11, and an optical sensor unit 20. The belt cleaning device 10 includes a brush roller or a cleaning blade.

The intermediate transfer belt 7 is nipped between the photoconductors 2 and the primary transfer rollers 9Y, 9C, 9M, and 9K. The portions where the photoconductors 2Y, 2M, 2C, and 2K are in contact with the outer surface of the intermediate transfer belt 7 are called primary transfer nips. The intermediate transfer unit 8 further includes a secondary transfer roller 12 disposed downstream from the image forming unit 1K in the direction of rotation of the intermediate transfer belt 7 (hereinafter "belt travel direction") and adjacent to the secondary-transfer backup roller 11. The secondary transfer roller 12 is disposed outside the loop of the intermediate transfer belt 7. The secondary transfer roller 12 nips the intermediate transfer belt 7 together with the secondary-transfer backup roller 11, to form a secondary transfer nip.

A fixing device 13 is disposed above the secondary transfer roller 12. The fixing device 13 includes a fixing roller and a pressing roller that press against each other while rotating. The contact portion therebetween is called a fixing nip. The fixing roller contains a heat source such as a halogen heater. A power source supplies power to the heater to heat the surface of the fixing roller to a predetermined temperature.

In a lower section of the apparatus body, sheet trays 14*a* and 14*b* for containing recording sheets S, sheet feeding rollers, and a registration roller pair 15 are disposed. Additionally, a side tray 14*c* is disposed on a side of the apparatus body for sheet feeding from the side. On the right of the intermediate transfer unit 8 and the fixing device 13 in FIG. 1, a sheet reversing unit 16 is disposed to again transport the recording sheet S to the secondary transfer nip in duplex printing.

In an upper section of the apparatus, toner containers 17Y, 17C, 17M, and 17K are disposed to supply toner to the respective developing devices 4 of the image forming units 1Y, 1C, 1M, and 1K. The printer 100 further includes a controller 30, a waste-toner bottle, a power supply unit, and the like.

When a print job is started, initially, a power source applies a predetermined or desirable voltage to the charging roller 3Y. Then, the charging roller 3Y charges the surface of the photoconductor 2Y facing the charging roller 3Y. The optical writing unit 6 directs the laser beam L according to the image data onto the surface of the photoconductor 2Y that is charged to a predetermined or desirable potential, thus forming an electrostatic latent image thereon. When the electrostatic latent image on the surface of the photoconductor 2Y reaches a position facing the developing roller 4*a*Y, the developing roller 4*a*Y supplies toner thereto, thereby forming a yellow toner image on the photoconductor 2Y. The developing device 4Y is supplied with toner from the toner containers 17Y in accordance with output from the toner concentration sensor.

Similar operation is performed in the image forming units 1C, 1M, and 1K at predetermined timings. Thus, yellow, cyan, magenta, and black toner images are formed on the photoconductors 2Y, 2C, 2M, and 2K, respectively. The yellow, cyan, magenta, and black toner images are transferred from the photoconductors 2Y, 2C, 2M, and 2K in the respective primary transfer nips and sequentially superimposed one on another on the intermediate transfer belt 7. To each of the primary transfer rollers 9Y, 9C, 9M, and 9K, a primary transfer bias that is opposite in polarity to the toner is applied from a primary-transfer power supply.

In the printer 100 according to the present embodiment, the primary transfer rollers 9Y, 9C, 9M, and 9K and the primary-transfer power supply together function as a transfer device to transfer the yellow, cyan, magenta, and black toner images from the photoconductors 2Y, 2C, 2M, and 2K onto the intermediate transfer belt 7 serving as a transfer medium or an intermediate transfer member (a drum, a belt, or the like). The primary transfer rollers and the primary-transfer power supply together function as a transfer device even when a conveyor belt is used instead of an intermediate transfer belt. In such a configuration, an endless conveyor belt is nipped between the photoconductor and the primary transfer roller, thus forming a primary transfer nip, to which the recording sheet S is transported, and the toner image is transferred from the photoconductor directly onto the recording sheet S. In such a configuration, a test toner image formed on the photoconductor can be transferred to not the recording sheet S but the surface of the conveyor belt serving as a transfer medium. Then, the amount of toner adhering to the test toner image on the conveyor belt can be detected.

The recording sheet S is fed from one of the sheet trays 14*a* and 14*b* and the side tray 14*c*, and the registration roller pair 15 stops the recording sheet S. The registration roller pair 15 rotates at a predetermined timing to forward the recording sheet S to the secondary transfer nip.

The toner images superimposed on the intermediate transfer belt 7 are transferred onto the recording sheet S in the secondary transfer nip, where the secondary transfer roller 12 is in contact with the intermediate transfer belt 7. A secondary transfer bias opposite in polarity to the toner is applied to the secondary transfer roller 12 from a secondary-transfer power supply.

After exiting the secondary transfer nip, the sheet S is transported to the fixing device 13 and nipped between the fixing roller and the pressing roller (i.e., the fixing nip). The toner image is fixed on the recording sheet S in the fixing nip with heat from the fixing roller. In single-side printing, after the toner image is fixed thereon, the recording sheet S is transported by conveyance rollers and ejected from the apparatus. In duplex printing, the conveyance rollers transport the recording sheet S to the sheet reversing unit 16, where the recording sheet S is turned upside down. Then, an image is formed on the opposite side of the recording sheet S, and the recording sheet S is ejected.

The printer 100 according to the present embodiment executes a control operation called "process control" at predetermined timings to stabilize image quality in accordance with environmental changes and with the elapse of time. In the process control, a yellow toner patch pattern (a toner image) including multiple toner patches is formed on the photoconductor 2Y and transferred onto the intermediate transfer belt 7. Similarly, cyan, magenta, and black toner patch patterns are formed on the photoconductors 2C, 2M, and 2K. Subsequently, the optical sensor unit 20, serving as a toner adhesion amount detector, detects the amount of toner adhering to each toner patch in the toner patch pattern. According to the detection results generated by the optical sensor unit 20, the controller 30 (illustrated in FIG. 3) adjusts image forming conditions such a developing bias Vb applied from a developing power unit 51.

Figure 3:
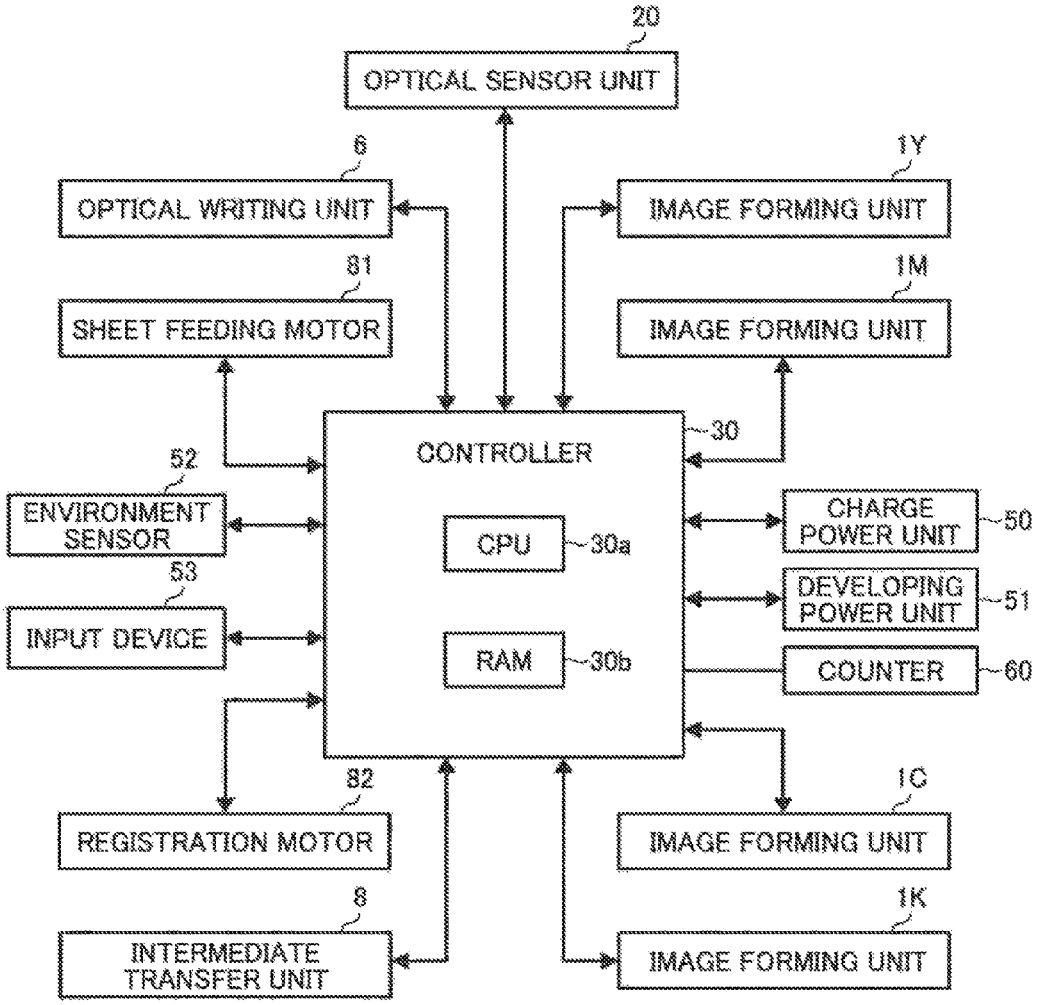
FIG. 3 is a block diagram illustrating electrical circuitry of the image forming apparatus illustrated in FIG. 1.
Figure 4:
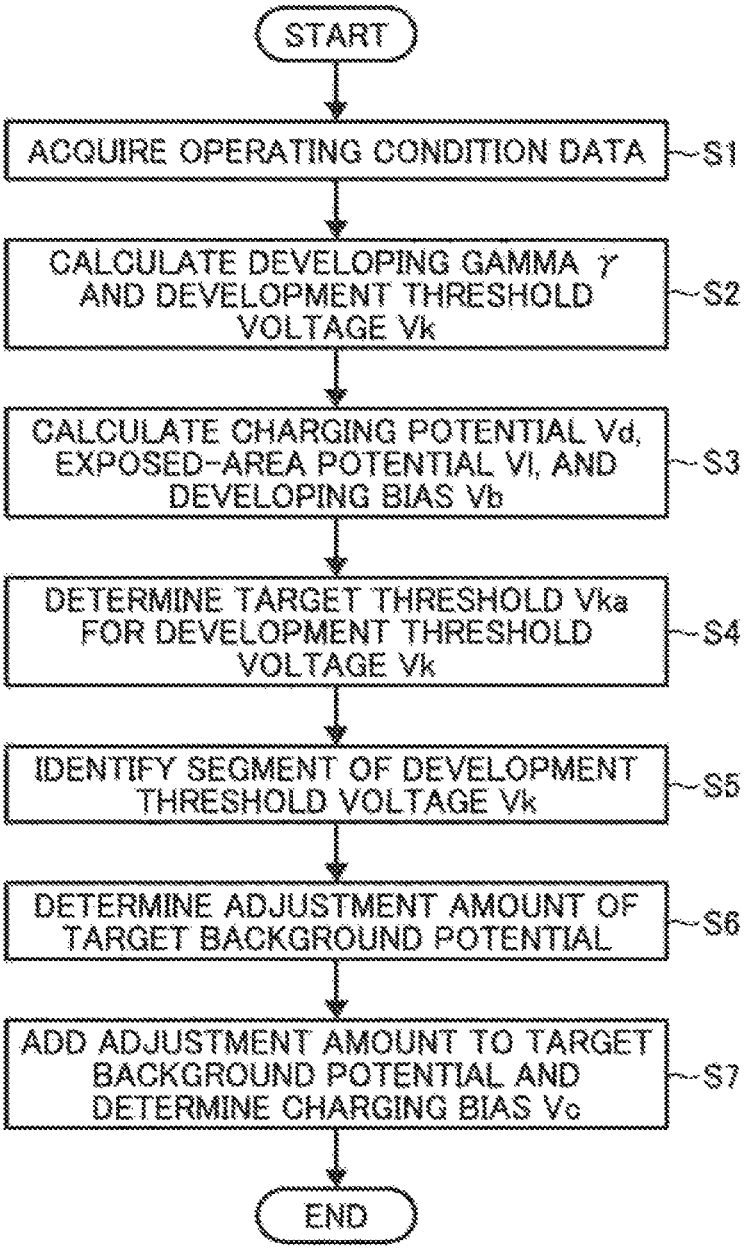
FIG. 4 is a flowchart of computation in process control according to an embodiment.

FIG. 3 is a block diagram illustrating electrical circuitry of the printer 100 according to the present embodiment. FIG. 4 is a flowchart of computation in the process control. As illustrated in FIG. 3, to the controller 30, the image forming units 1Y, 1C, 1M, and 1K, the optical writing unit 6, a sheet feeding motor 81, a registration motor 82, the intermediate transfer unit 8, the optical sensor unit 20, and an input device 53 are connected electrically. The controller 30 includes a central processing unit (CPU) 30*a* to execute computation and various types of programs and a random access memory (RAM) 30*b* to store data. It is to be noted that the sheet feeding motor 81 serves as a driver to drive the sheet feeding rollers to feed sheets from the sheet trays 14*a* and 14*b* and the side tray 14*c*. The registration motor 82 serves as a driver of the registration roller pair 15.

The optical sensor unit 20 includes multiple reflective photosensors arranged at regular intervals in a width direction of the intermediate transfer belt 7. Each of the reflective photosensors is configured to output a signal corresponding to the reflectance of light of the toner patches on the intermediate transfer belt 7. In the present embodiment, there are four reflective photosensors. Three of the four reflective photosensors capture both of speculator reflection and diffuse reflection of light on the surface of the belt and output signals according to the amount of speculator reflection of light and diffuse reflection light so that the output correspond to yellow, magenta, and cyan toner. The remaining one captures only the speculator reflection on the surface of the belt and outputs the signal according to the amount of speculator reflection light so that the output corresponds to black toner.

The controller 30 executes the process control at a predetermined timing, such as, turning on of a main power, standby time after elapse of a predetermined period, and standby time after printing on a predetermined number of sheets or greater. The steps in the process control are described with reference to FIG. 4. At S1, when the predetermined timing arrives, the controller 30 acquires operating condition data such as the number of sheets printed, the printing ratio, ambient temperature, and ambient humidity. Subsequently, the controller 30 determines developing characteristics in each of the image forming units 1Y, 1C, 1M, and 1K. Specifically, at S2, the controller 30 calculates a developing gamma γ and a development threshold voltage for each color. More specifically, while the photoconductors 2Y, 2C, 2M, and 2K rotate, the charging rollers 3 charge uniformly the surfaces of the photoconductors 2Y, 2C, 2M, and 2K, respectively. In the charging, differently from standard printing, the charging bias Vc is not constant (e.g., −700 V) but is increased in absolute value stepwise. With the scanning with the laser beams L, the optical writing unit 6 forms electrostatic latent images for the yellow, cyan, magenta, and black toner patch patterns on the photoconductors 2Y, 2C, 2M, and 2K. The laser beam intensity at that time is set to an intensity sufficient to saturate the amount by which the photoconductor potential is attenuated by the exposure. The developing devices 4Y, 4C, 4M, and 4K develop the latent images into the yellow, cyan, magenta, and black toner patch patterns (i.e., patch pattern toner images) on the photoconductors 2Y, 2C, 2M, and 2K. It is to be noted that, in the developing process, the controller 30 stepwise increases the absolute value of the developing bias Vb applied to the developing rollers 4*a* for the respective colors, in accordance with the above-described charging potential. In accordance with the different values of the developing bias Vb, the toner pattern including multiple sections different in toner adhesion amount is formed on the photoconductor 2. In the present embodiment, the developing bias Vb and the charging bias Vc are DC biases in negative polarity.

Figure 5:
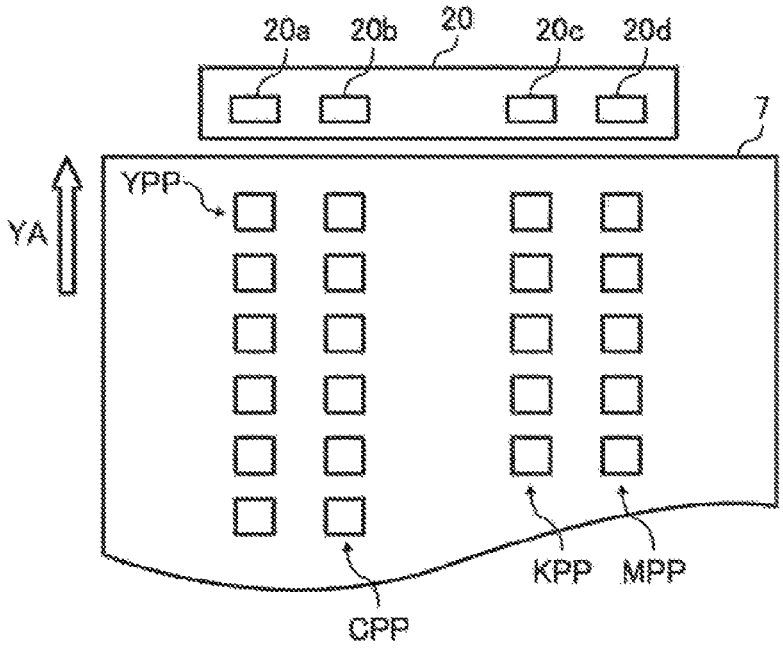
FIG. 5 is a schematic diagram illustrating toner patch patterns on an intermediate transfer belt of in the image forming apparatus illustrated in FIG. 1.

In FIG. 5, reference characters YA represents the belt travel direction; and YPP, CPP, KPP, and MPP respectively represent the yellow, cyan, magenta, and black toner patch patterns (collectively "toner patch patterns PP") on the intermediate transfer belt 7. As illustrated in FIG. 5, the yellow, cyan, magenta, and black toner patch patterns YPP, CPP, MPP, and KPP (patch pattern toner images) do not overlap with each other on the intermediate transfer belt 7 but are lined in the width direction of the intermediate transfer belt 7 (hereinafter "belt width direction"). Specifically, the toner patch pattern YPP is disposed on a first end side (on the left in FIG. 5) of the intermediate transfer belt 7 in the belt width direction. The toner patch pattern CPP is disposed at a position shifted to a center from the toner patch pattern YPP on the intermediate transfer belt 7 in the belt width direction. The toner patch pattern MPP is disposed on a second end side (on the right in FIG. 5) of the intermediate transfer belt 7 in the belt width direction. The toner patch pattern KPP is disposed at a position shifted to the center from the toner patch pattern MPP on the intermediate transfer belt 7 in the belt width direction.

The optical sensor unit 20 includes a first reflective photosensor 20*a*, a second reflective photosensor 20*b*, a third reflective photosensor 20*c*, and a fourth reflective photosensor 20*d* to detect the light reflection characteristics of the intermediate transfer belt 7 at positions different in the belt width direction. Of the four reflective photosensors, the third reflective photosensor 20*c* detects only the speculator reflection of light on the surface of the intermediate transfer belt 7 to detect changes in the light reflection characteristics derived from the amount of black toner adhering to the intermediate transfer belt 7. By contrast, the first, second, and fourth reflective photosensors 20*a*, 20*b*, and 20*d* detect both of the speculator reflection and the diffuse reflection of light to detect changes in the light reflection characteristics derived from the amount of yellow, cyan, or magenta toner adhering to the intermediate transfer belt 7.

The first reflective photosensor 20*a* is disposed to face the first end side of the intermediate transfer belt 7 in the belt width direction to detect the amount of toner adhering to the yellow toner patches in the toner patch pattern YPP. The second reflective photosensor 20*b* is disposed to face the position shifted from the first end side to the center in the belt width direction of the intermediate transfer belt 7 to detect the amount of toner adhering to the cyan toner patches in the toner patch pattern CPP. The fourth reflective photosensor 20*d* is disposed to face the second end side of the intermediate transfer belt 7 in the belt width direction to detect the amount of toner adhering to the magenta toner patches in the toner patch pattern MPP. The third reflective photosensor 20*c* is disposed to face the position shifted from the second end side to the center in the belt width direction of the intermediate transfer belt 7 to detect the amount of toner adhering to the black toner patches in the toner patch pattern KPP. It is to be noted that each of the first reflective photosensor 20*a*, the second reflective photosensor 20*b*, and the fourth reflective photosensor 20*d* can detect the amount of any of yellow, cyan, and magenta toner other than black toner.

The controller 30 calculates the reflectance of light of the toner patches of the four colors based on the signals sequentially output from the four photosensors (20*a*, 20*b*, 20*c*, and 20*d*) of the optical sensor unit 20. The controller 30 obtains the amount of toner adhering (also "toner adhesion amount)" to each toner patch based on the computation result and stores the calculated toner adhesion amount in the RAM 30*b*. After passing by the position facing the optical sensor unit 20 as the intermediate transfer belt 7 rotates, the toner patch patterns PP are removed from the intermediate transfer belt 7 by the belt cleaning device 10.

Figure 6:
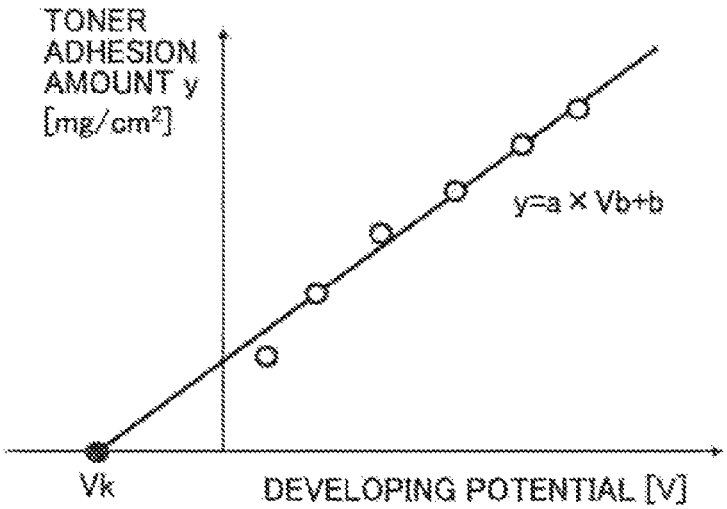
FIG. 6 is a graph illustrating a relation between developing potential and toner adhesion amount.

Subsequently, the controller 30 obtains an approximate straight line based on the image density data (i.e., toner adhesion amounts) thus stored in the RAM 30*b* and the developing potential, which is the difference between the exposed-area potentials (i.e., latent image potentials) and the developing bias used for the pattern formation, stored in the RAM 30*b* as well. FIG. 6 illustrates the approximate straight line, expressed as:

$$y=a\times(V1-Vb)+b.$$

In the two-dimensional coordinate illustrated in FIG. 6, the x-axis represents the developing potential (V1−Vb), which is obtained by deducting, from the exposed-area potential V1, the developing bias Vb applied to the developing roller 4*a* at that time. The y-axis in FIG. 6 represents the toner adhesion amount (y) per unit area. The number of data values plotted on X-Y plane in FIG. 6 matches the number of the toner patches. Based on the multiple data values plotted, a section of the X-Y plane in which linear approximation is executed is determined. The controller 30 obtains the approximate straight line (y=a×Vb+b) through a least squares method. Then, based on the approximate straight line, the controller 30 calculates the developing gamma γ and the development threshold voltage Vk. The developing gamma γ is calculated as the inclination of the approximate straight line (γ=a). The development threshold voltage Vk is calculated as the intersection of the approximate straight line with the x-axis (Vk=−b/a). Thus, the developing characteristics of the image forming units 1Y, 1C, 1M, and 1K are calculated at S2.

At S3, based on the calculated developing characteristics, the controller 30 calculates a target for the charging potential Vd (i.e., background potential), the exposed-area potential Vl, and the developing bias Vb. Specifically, the developing bias Vb is obtained as follows. The controller 30 obtains a developing potential to attain a largest toner adhesion amount based on the combination of the developing gamma γ and the development threshold voltage Vk. Then, the controller 30 obtains the developing bias Vb with which such developing potential is attained, based on the exposed-area potential Vl during the previous process control. Subsequently, based on the developing bias Vb and the preset background potential, the controller 30 calculates the target charging potential.

After the target charging potential is calculated, the exposed-area potential Vl corresponding to the target charging potential is identified using a lookup table, which is constructed in the RAM 30*b* based on results of an experiment performed beforehand. The exposed area potential does not significantly change even when the charging potential changes significantly. In a case where the difference between the exposed-area potential Vl during the previous process control and the exposed-area potential Vl identified currently is not greater than a threshold, determination of the charging potential Vd, the exposed-area potential Vl, and the developing bias Vb is completed.

In a case where the change of the exposed-area potential Vl is greater than or equal to the threshold, the controller 30 recalculates the developing bias Vb based on the latest exposed-area potential Vl and recalculates the charging potential Vd. Then, determination of the charging potential Vd, the exposed-area potential Vl, and the developing bias Vb is completed. Since the surface of the developing sleeve of the developing roller 4*a* has a potential similar to the developing bias Vb, the target developing potential and the target background potential are obtained when the surface of the photoconductor 2 is charged to the target charging potential and exposed properly.

Subsequently, the controller 30 determines the charging bias Vc. Specifically, the charging bias Vc to attain the target charging potential varies depending on the amount of abrasion of the surface layer of the photoconductor 2, the electrical resistance of the charging roller 3 susceptible to environmental changes, and the like. Accordingly, the controller 30 stores an algorithm to calculate the charging bias Vc with which the target charging potential is attained. The algorithm is based on the combination of environmental conditions (temperature and humidity), the running distance of the photoconductor 2 (hereinafter "photoconductor running distance"), and the average coverage rate at that photoconductor running distance. The algorithm is preliminarily established experimentally. Using the algorithm, the controller 30 calculates the charging bias Vc with which the target charging potential is attained, based on the combination of the detection result generated by an environment detector 52, the photoconductor running distance stored in the RAM 30*b*, and the average coverage rate. The photoconductor running distance represents the amount by which the apparatus has been used (i.e., operating amount of the apparatus). For example, a counter 60 counts the number of sheets fed in the printer. Based on the count by the counter 60, the controller 30 obtains the rotation distance (operating amount) of the photoconductor 2. That is, the counter 60 serves as an operating amount detector to detect the amount by which the image bearer has been used.

Due to the characteristics of developer, the background fog (background stain) is aggravated with elapse of time. By contrast, adhesion of carrier (adhesion to image edges on the photoconductor 2) is worse at an initial stage and alleviated with elapse of time. Accordingly, an optimum background potential shifts to a greater value as the developer is used. Further, typically, in a hot and humid environment, the background fog is aggravated because the amount of charge of toner is smaller. By contrast, in a cool and dry environment, the adhesion of carrier is aggravated. Therefore, in image density adjustment according to the present embodiment, the background potential is adjusted to an optimum value depending on the stage of use and environment.

The environment detector 52 is used to detect the environment around the charging roller 3 and the photoconductor 2. For example, the environment detector 52 is attached to a board on which electrical components are mounted.

The background potentials suitable to suppress the background fog and the adhesion of carrier under various conditions have been experimentally obtained. Accordingly, the background potential can be adjusted to a certain degree based on data on degradation of the charging roller 3 and the carrier and operating condition data such as changes in temperature and humidity. However, it is possible that the optimum background potential fluctuates due to tolerances or errors from conditions in the experiment or an unexpected factor. Meanwhile, since the development threshold voltage Vk is equivalent to the voltage at which developing starts on the photoconductor 2, it is conceivable that background fog worsens unless the background potential is equal to or greater in absolute value than the development threshold voltage Vk.

In view of the foregoing, after calculating the charging potential Vd, the exposed-area potential V1, and the developing bias Vb at S3 in FIG. 4, at S4 the controller 30 determines a target for the development threshold voltage Vk (hereinafter "target development threshold Vka"). The target development threshold Vka is preliminarily and experimentally correlated with the operating condition data in a table stored in the RAM 30*b*. The controller 30 determines the target development threshold Vka from the operating condition data initially obtained, with reference to the table. At S5, the controller 30 determines a segment based on the difference between the development threshold voltage Vk and the target development threshold Vka. The difference from the target development threshold Vka is segmented as follows. For example, in a case where the development threshold voltage Vk is different from the target development threshold Vka by +40 V or greater, the development threshold voltage Vk is in Segment 1. Segment 2 is for the difference greater than or equal to +20 V and smaller than +40 V, and Segment 3 is for the difference greater than or equal to 0 V and smaller than +20 V. The controller 30 identifies the segment in which the development threshold voltage Vk falls. At S6, the controller 30 determines an adjustment amount for each segment. Subsequently, the controller 30 adds the adjustment amount determined at S6 to the background potential calculated from the charging potential Vd and the developing bias Vb obtained at S3. Thus, the target background potential is calculated. At S7, the controller 30 calculates the charging bias Vc to obtain the target background potential.

Figure 7:
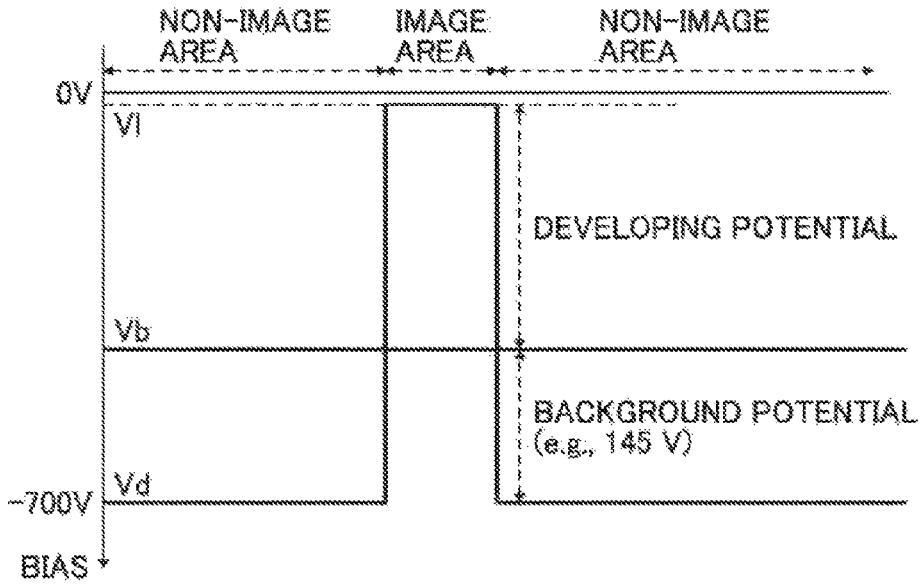
FIG. 7 is a graph of developing potential and background potential.

FIG. 7 is a graph of the developing potential and the background potential. As illustrated in FIG. 7, the background potential is the difference between the charging potential Vd and the developing bias Vb and acts in the non-image area (the background area). The possibility of occurrence of background fog increases as the background potential decreases, but the possibility of occurrence of adhesion of carrier increases as the background potential increases. Therefore, it is preferred to determine the background potential considering both of background fog and carrier adhesion.

Figure 8:
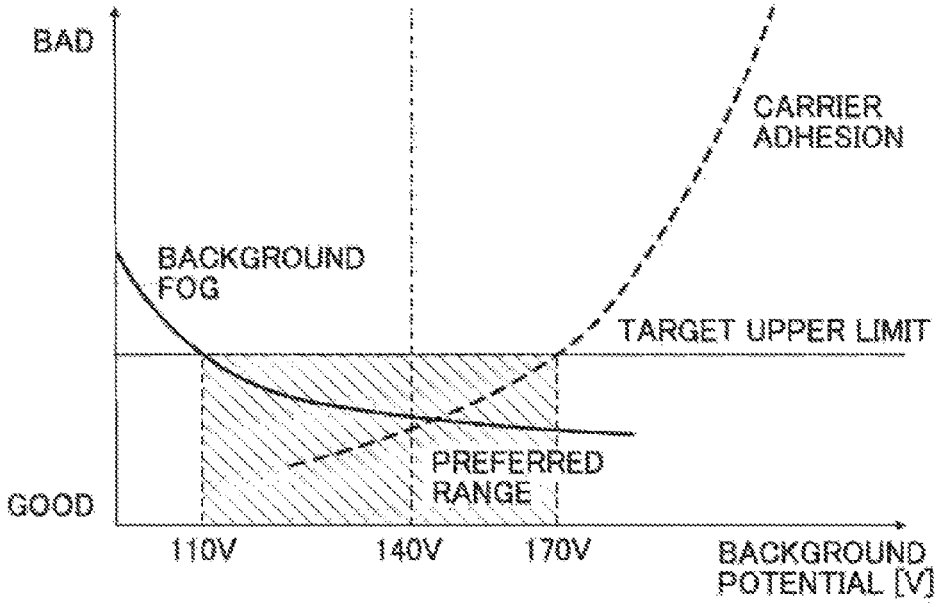
FIG. 8 is a graph illustrating a relation between the background potential and the degree of background fog (stain by adhering toner) and the degree of carrier adhesion.

FIG. 8 is a graph illustrating a relation between the background potential and the degree of background fog and the degree of carrier adhesion. In this example, a theoretical value of the background potential is set to 140 V based on the process control. The term "theoretical value" is used from the following reason. As described above, in the process control, the background potential is determined based on the relation between the proper charging potential Vd and the developing bias Vb, and the charging bias Vc is determined based on the determined background potential. However, it is possible that the charging potential Vd attained by the charging bias Vc is different from the target charging potential. Since a discharge start voltage, at which electrical discharge starts between the charging roller and the photoconductor, varies depending on various factors, the charging bias Vc to attain the charging potential Vd varies accordingly. In the process control, although the environment and the photoconductor running distance are considered to determine the charging bias Vc, the theoretical value calculated based on the algorithm does not always match actual conditions. Additionally, the value of the charging bias Vc to attain the same charging potential Vd can vary depending on another parameter different from the environment and the photoconductor running distance.

In the example illustrated in FIG. 8, both of background fog and carrier adhesion are inhibited when the background potential is about 140 V. Therefore, in the process control, the controller 30 determines the target charging potential to attain a background potential of, for example, 140 V, and a desirable developing potential. However, the charging bias Vc determined in the process control does not necessarily attain the target charging potential because the charging bias Vc to attain the charging potential Vd fluctuates depending on various factors. In some cases, the actual charging potential Vd can significantly deviate from the target charging potential (140 V in FIG. 8). In that case, in FIG. 8, it is possible that the actual background potential exceeds 170 V and carrier adhesion occurs, or the actual background potential falls below 110 V and background fog occurs.

Figure 9:
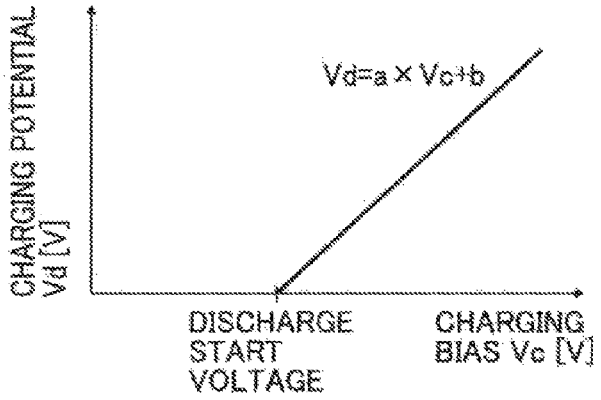
FIG. 9 is a graph illustrating a relation between a charging potential and a charging bias.

As described above, the charging bias Vc is applied to the charging roller 3, which is a rubber roller. As illustrated in FIG. 9, the charging potential Vd of the photoconductor 2 exhibits the characteristic:

$$Vd=a\times Vc+b,$$

where "a" represents the inclination of the graph illustrated in FIG. 9, and "b" represents the intercept of the y-axis representing the charging potential Vd in FIG. 9. The y-axis intercept on the graph is almost equal to the discharge start voltage between the charging roller and the photoconductor. Additionally, the inclination a is almost equal to 1.

As described above, the printer 100 employs the contact-type DC charging, in which the charging bias Vc including the DC bias without an AC component is applied to the charging roller 3 in contact with the photoconductor 2. Differently from a charging method in which the charging bias is a superimposed bias including an AC component and a DC component, the contact-type DC charging does not requires an AC power supply, and thus the cost is lower. Meanwhile, since an alternating electrical field is not generated between the charging roller 3 and the photoconductor 2, unless the charging bias Vc is greater than the discharge start voltage illustrated in FIG. 8, discharging does not occur between the charging roller 3 and the photoconductor 2. Then, the photoconductor 2 is not charged at all. Even if the photoconductor 2 is charged, the charging potential Vd fluctuates under the same charging bias Vc because the discharge start voltage changes depending on the environment, the abrasion amount of the photoconductor 2, the electrical resistance of the charging roller 3, and the stain on the charging roller 3. Accordingly, it is difficult to keep the charging potential Vd at a desirable value compared with AC charging.

Figure 10:
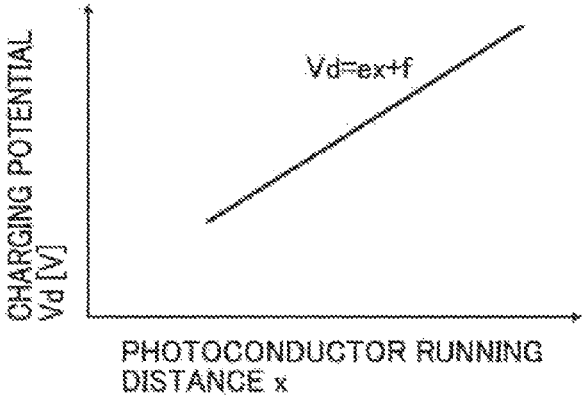
FIG. 10 is a graph illustrating a relation between the charging potential and a photoconductor running distance.

FIG. 10 is a graph illustrating a relation between the charging potential Vd and the photoconductor running distance, which is given a reference character "x". The photoconductor running distance x represents an accumulative value by which the surface of the photoconductor 2 moves as the photoconductor 2 rotates. As illustrated in FIG. 10, the charging potential Vd exhibits the characteristic expressed as:

$$Vd=ex+f,$$

where e represents the inclination of the graph in FIG. 10, and f represents the intercept of the y-axis representing the charging potential Vd. The inclination e and the intercept f are not constant and vary at random with elapse of time from the following reasons. Since the cleaning blade and developer rub against the surface of the photoconductor 2, the surface layer of the photoconductor 2 is abraded with the elapse of time. As the amount of abrasion increases, the capacitance of the photoconductor 2 increases gradually. Accordingly, the discharge start voltage falls, and the charging potential Vd rises. Additionally, the amount of abrasion varies depending on various factors such as image area, image shape, environment, and carrier adhesion. For example, when the image is shaped like a vertical ribbon, that is, the image is present only in a portion in the main scanning direction, the photoconductor 2 is abraded in the contact portion with the image. In addition, the stain on the surface of the charging roller 3, which is caused by toner and additives to toner, varies at random, and the discharge start voltage varies accordingly. From those reasons, the inclination e and the intercept f vary at random with elapse of time. It is difficult to arithmetically calculate the charging potential Vd due to the above-described reasons and the fact that directly measuring the abrasion amount of the surface layer of the photoconductor 2 is not available.

By contrast, in electrophotography, it is preferred to control the exposure (the intensity of light to write latent images) to stabilize image density. When the exposure exceeds an optimum value, dot diameter and line width increase, and image shape is blurred in halftone portions. When the exposure falls below the optimum value, white voids (toner is partly absent) occurs in highlight portions.

Figure 11:
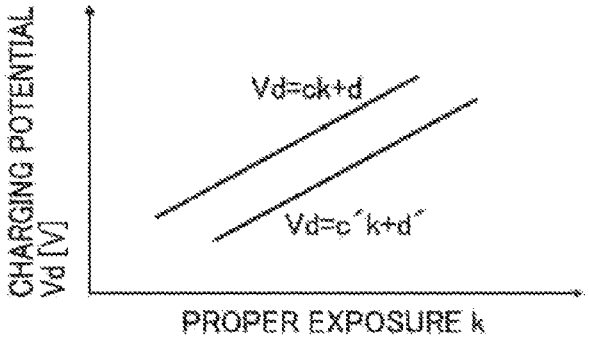
FIG. 11 is a graph illustrating a relation between the charging potential and an optimum value of exposure.

FIG. 11 is a graph illustrating a relation between the charging potential Vd and the optimum value of the exposure ("proper exposure k" in FIG. 11). In the initial stage of use of the photoconductor 2, the charging potential Vd exhibits the relation expressed as:

$$Vd=ck+d,$$

where c represents the inclination of the graph in FIG. 11, and d represents the intercept of the y-axis representing the charging potential Vd. In a case where the exposure is kept constant, it is necessary to stabilize the charging potential Vd to attain a desirable image density. Additionally, as the photoconductor 2 ages, the relation between the charging potential Vd and the proper exposure k changes to Vd=c'k+d'. Therefore, keeping the exposure constant is not sufficient to maintain the desirable image density.

Figure 12:
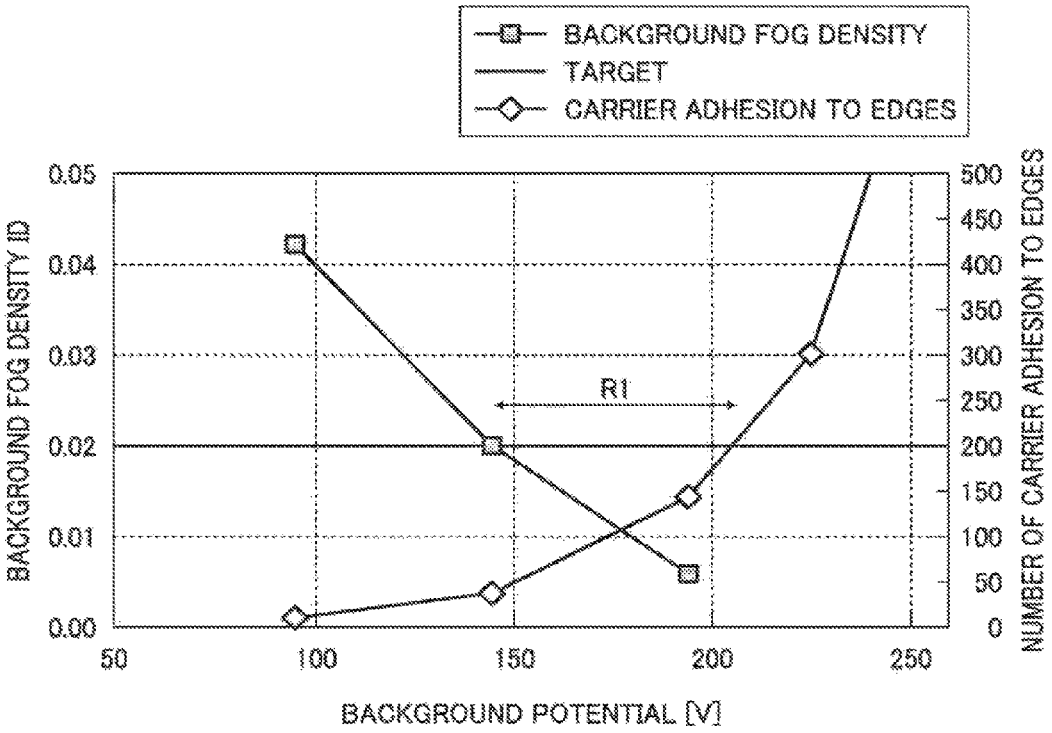
FIG. 12 is a graph illustrating a relation between background fog density, background potential, and carrier adhesion to image edges on a photoconductor.

FIG. 12 is a graph illustrating a relation between background fog density, the background potential, and carrier adhesion to image edges (amount of carrier adhering to the photoconductor 2). To obtain the background fog density (i.e., image density or ID), toner adhering to the background area on the photoconductor 2 is transferred onto a piece of adhesive tape, and the image density on the adhesive tape is measured as the background fog density. To obtain the carrier adhesion to edges (i.e., image edges on the photoconductor 2), a test image including a large area in which edges are emphasized is formed, and magnetic carrier particles adhering to the edges or areas adjacent to edges of the test image on the photoconductor 2 are counted. As illustrated in FIG. 12, the background fog density (ID) increases as the background potential decreases. By contrast, the carrier adhesion to edges increases as the background potential increases. In the graph, an optimum value of the background potential is about 180 V. Unless the background potential is kept at the optimum value ±30 V (i.e., a preferred range R1 in FIG. 12), the background fog and the carrier adhesion can occur. Although the optimum value varies depending on apparatus type, the variation of the optimum value is small in apparatuses of same type.

Therefore, the controller 30 is configured to adjust the charging bias Vc to attain the target charging potential, as required, after performing the process control.

In the charging bias adjustment, the controller 30 executes the following process to form a background fog pattern for each color on the intermediate transfer belt 7. Initially, in a state in which the optical writing unit 6 is deactivated, while rotating the photoconductor 2, the controller 30 changes the charging bias Vc stepwise to form multiple sections different in charging potential Vd on the surface of the photoconductor 2 along the circumference (in arc-shaped direction) thereof. As the photoconductor 2 rotates, those sections pass through the developing position. Then, the background fog pattern including the multiple sections different in the amount of background fog is formed on the photoconductor 2 due to the difference in the background potentials. The background fog pattern is transferred onto the intermediate transfer belt 7. It is to be noted that the background fog patterns of different colors are transferred at positions not overlapping with each other in the belt travel direction YA.

Figure 13:
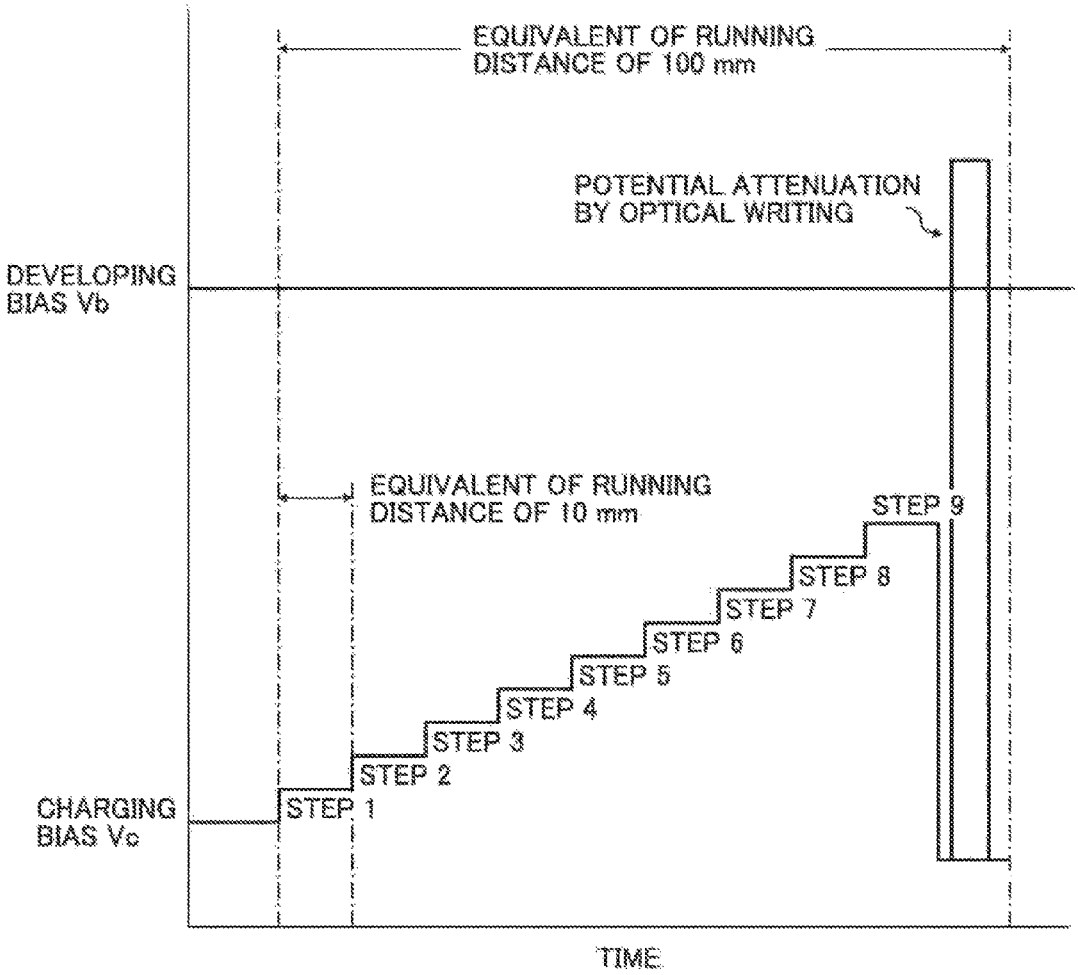
FIG. 13 is a graph illustrating potential changes with elapse of time in formation of a background fog pattern in an image forming unit for yellow.

FIG. 13 is a graph illustrating different potentials generated stepwise with time to form the background fog pattern in the image forming unit 1Y. In forming the background fog pattern for yellow, while keeping the developing bias constant, the controller 30 changes the charging bias Vc stepwise to form a pattern having multiple sections different in the charging potential Vd. Since both of the developing bias Vb and the charging bias Vc have negative polarity in the present embodiment, the absolute values of the biases increase as the position in the graph descends. The charging bias Vc is changed in nine steps, and, for example, at the initial step (Step 1), the charging bias Vc is a DC bias of −1350 V. Subsequently, the controller 30 reduces the charging bias Vc by 20 V each elapse of time equivalent to the photoconductor running distance of 10 mm. That is, the charging bias V is −1330 V at Step 2 and −1310 V at Step 3.

The yellow background fog pattern formed on the photoconductor 2Y is transferred onto the intermediate transfer belt 7 in the primary transfer nip. Similarly, the cyan, magenta, and black background fog patterns are transferred onto the intermediate transfer belt 7.

While forming the background fog patterns, the controller 30 acquires the outputs from the reflective photosensors 20*a*, 20*b*, 20*c*, and 20*d* and stores the outputs in the RAM 30*b*, timed to coincide with arrival of the background fog patterns at the position (detection position) facing the optical sensor unit 20. The controller 30 then acquires the toner adhesion amount (background fog amount) based on the mean value of the output values for each section. Subsequently, based on the background fog amounts (the amount of toner adhering to the background fog patterns) and the values of the charging bias Vc of the sections corresponding to the background fog amounts, the controller 30 identifies the value of the charging bias Vc to keep the background fog density within a tolerable range. Based on the identified value, the controller 30 computes a charging bias adjustment amount. Then, the controller 30 renews the setting of the charging bias Vc for printing to a value adjusted with the charging bias adjustment amount. With this control, the surface of the photoconductor 2 is charged approximately to the target charging potential to secure the desired background potential, thereby inhibiting background fog and carrier adhesion.

In printing operation, the controller 30 sends, to the charge power unit 50, a command signal to instructing output of the charging bias Vc. The command signal corresponds to the setting of the charging bias Vc. Then, the charge power unit 50 outputs the charging bias Vc identical to the setting. It is to be noted that the charging roller 3 is capable of outputting, to the charge power unit 50, the charging bias Vc having a value independent for each of yellow, cyan, magenta, and black.

Figure 14:
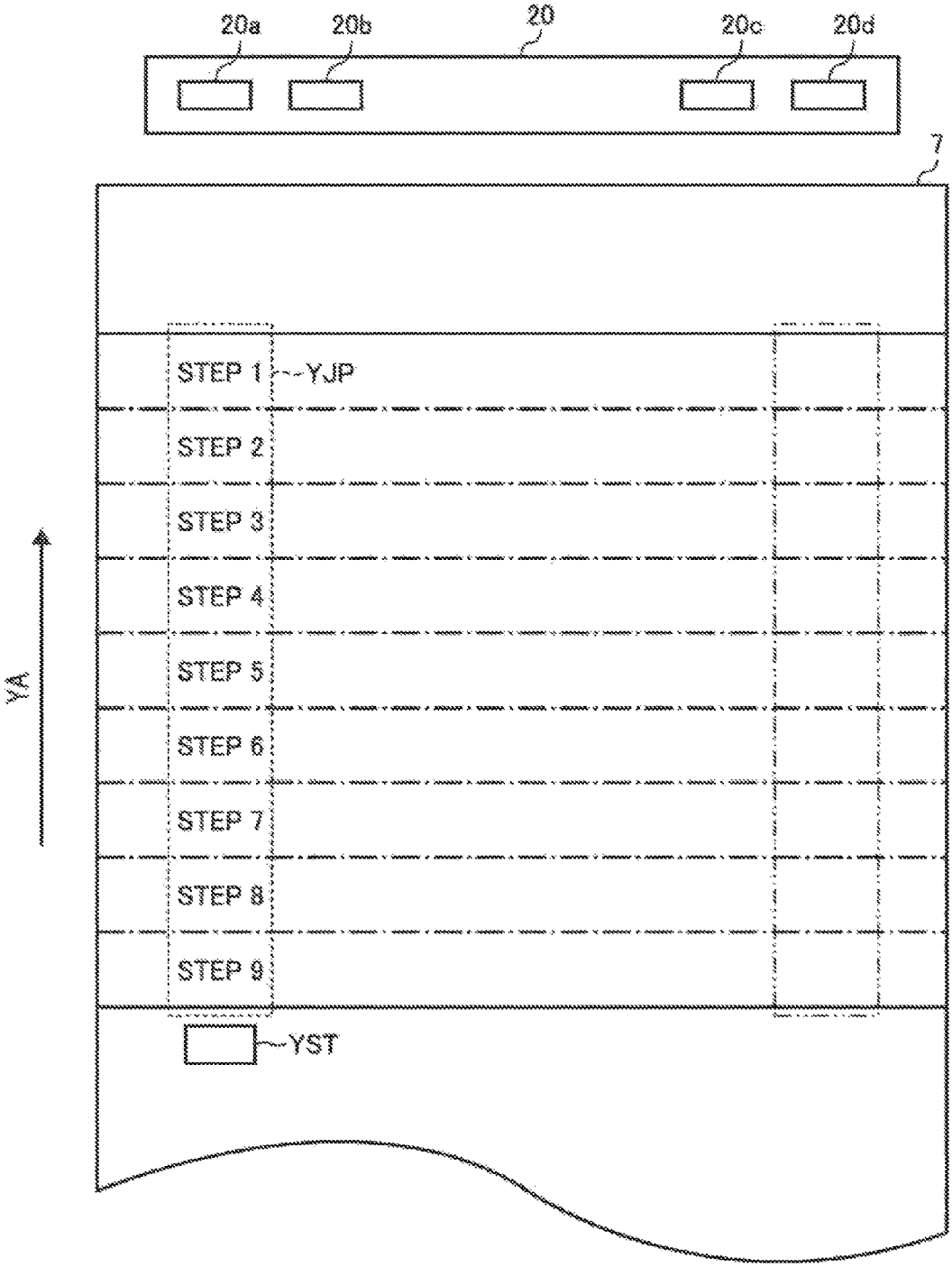
FIG. 14 is a plan view illustrating a yellow background fog pattern on the intermediate transfer belt employed in the image forming apparatus illustrated in FIG. 1.

FIG. 14 is a schematic plan view illustrating the background fog pattern for yellow, given reference character "YJP" on the intermediate transfer belt 7. In the drawing, for ease of understanding, the borders of the sections of the yellow background fog pattern YJP are indicated by alternate long and short dashed lines. In the present embodiment, it is not necessary that the background fog pattern extends entirely in the belt width direction. It is sufficient that the background fog pattern is present only in the range detected by the reflective photosensors 20*a*, 20*b*, 20*c*, and 20*d* out of the entire range in the belt width direction. Other ranges than the detected range can be the background without the background fog pattern. In practice, the background fog is caused entirely in the belt width direction, and a toner image according to image date is not formed on the intermediate transfer belt 7. However, in FIG. 14, a portion in the belt width direction is enclosed with broken lines to indicate the presence of the background fog pattern, and the reference "YJP" is given to that portion. Specifically, since the first reflective photosensor 20*a*, out of the four reflective photosensors 20*a*, 20*b*, 20*c*, and 20*d*, detects the toner adhering amount of the yellow background fog pattern YJP in the present embodiment, only the range that passes through the position under the first reflective photosensor 20*a* is regarded as the yellow background fog pattern YJP as indicated by broken lines in the drawing. In a configuration in which the fourth reflective photosensor 20*d* is used to detect the toner adhering amount of the yellow background fog pattern YJP, the yellow background fog pattern YJP is disposed in the range indicated by the chain double-dashed line in that drawing.

As illustrated in the drawing, in the present embodiment, a yellow toner image YST for locating is formed immediately following the yellow background fog pattern YJP. To form an electrostatic latent image of the yellow toner image YST for locating, as illustrated in FIG. 14, after the charging bias Vc at Step 9 is applied to the charging roller 3, optical writing is executed on the photoconductor 2 with the absolute value of the charging bias Vc made greater than the charging bias Vc at Step 1.

The controller 30 starts sampling slightly earlier than a theoretical timing (a calculated time value) at which the yellow background fog pattern YR, illustrated in FIG. 14, reaches the position (detection position) under the first reflective photosensor 20*a*. The controller 30 samples the outputs from the first reflective photosensor 20*a* and stored the sampled output at high-speed cycles (time intervals). A timing at which the output from the first reflective photosensor 20*a* changes significantly is stored as the timing at which the yellow toner image YST for locating arrives at the position under the first reflective photosensor 20*a*. Simultaneously, the controller 30 completes the sampling. The controller 30 then segments the sampled data values in time series and constructs a group of sampled data values corresponding to each section of the yellow background fog pattern YR. Constructing the group of sampled data values is equivalent to determining the timing at which each section arrives at the detection position.

After constructing the group of sampled data values for each section, the controller 30 computes the toner adhesion amount in each section.

Similar to yellow, for each of cyan, magenta, and black, a toner image for locating is formed immediately following the background fog pattern, and a group of sampled data values is constructed based on the timing at which the toner image for locating is detected. It is to be noted that the background fog pattern of each of yellow, cyan, and magenta can be disposed at any position in the belt width direction as long as the position is detected by one of the first, second, and fourth reflective photosensors 20*a*, 20*b*, and 20*d*. However, in the present embodiment, the background fog pattern of each of yellow, cyan, and magenta is disposed at the position detected by either the first reflective photosensor 20*a* or the fourth reflective photosensor 20*d* due to the reason described later.

Additionally, the background fog pattern of black is disposed at the position detected by any one of the four reflective photosensors (20*a*, 20*b*, 20*c*, and 20*d*) in the belt width direction because the black toner adhesion amount can be computed using the output based on only the speculator reflection of light even when the first photosensor 20*a*, the second photosensor 20*b*, or the fourth reflective photosensor 20*d* is used. However, in the present embodiment, the background fog pattern of black is also disposed at the position detected by either the first reflective photosensor 20*a* or the fourth reflective photosensor 20*d* due to the reason described later.

When the toner image for locating, for which adhesion of toner to the electrostatic latent image is actively promoted with the developing potential, arrives at the position detected by the reflective photosensor (20*a* or 20*d* in the present embodiment), the sensor output changes significantly. Therefore, the timing at which the toner image for locating arrives at the detection position can be measured precisely based on the changes in the sensor output. The time difference between the arrival timing of the toner image for locating and the arrival timing of each section of the background fog pattern is significantly smaller than the time difference between the timing at which stepwise change of the charging bias Vc is started to form the background fog pattern and the timing at which each section of the background fog pattern arrives at the detection position. Since the time difference is smaller, the arrival timing can be detected accurately, differently from a case where the timing at which each section arrives at the detection position is determined based on the timing at which the stepwise change of the charging bias Vc is started. This configuration suppresses the occurrence of background fog and carrier adhesion resulting from low accuracy in determining the arrival timing of each section of the background fog pattern at the detection position.

In the present embodiment, the distance between the image forming stations is set to 100 mm. The distance between the image forming stations means the arrangement pitch of the image forming units 1 adjacent to each other in the belt travel direction and equivalent to the distances between the adjacent primary transfer nips. In the belt travel direction YA, the length starting from the leading end of the background fog pattern to the trailing end of the toner image for locating is shorter than the distance (100 mm, for example) between the image forming stations. With this setting, the background fog patterns of the four colors do not overlap even when the positions thereof are identical in the belt width direction. Further, formation of the background fog patterns of the four colors can be started almost simultaneously to shorten the duration of the charging bias adjustment.

Figure 15:
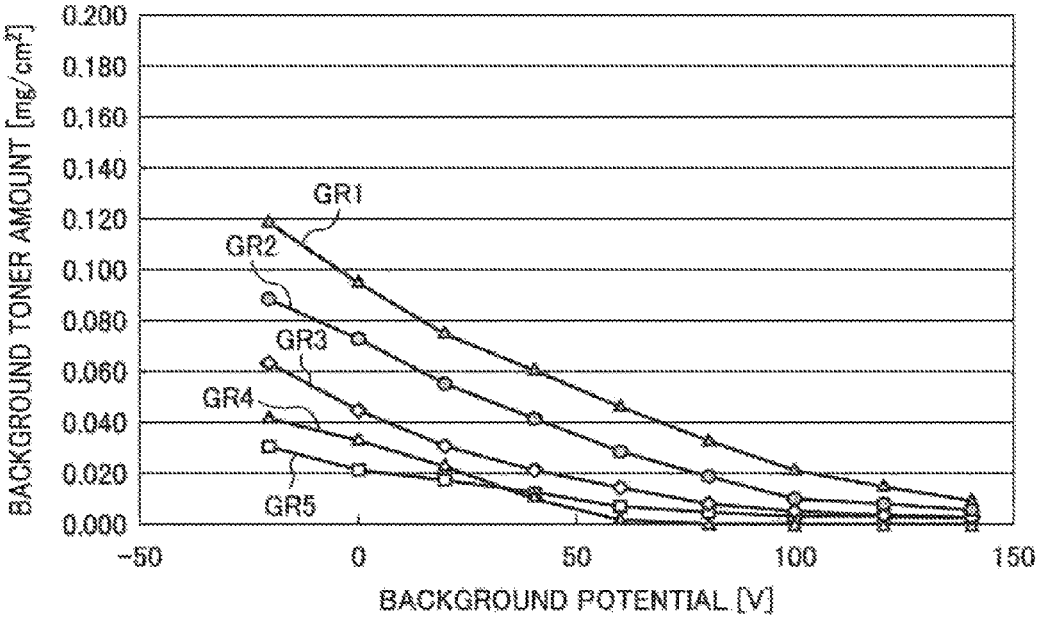
FIG. 15 is a chart illustrating relations between the amount of background fog toner and the background potential in multiple sections of the background fog pattern.

FIG. 15 is a chart illustrating relations between the amount of background fog toner and the background potential in multiple sections of the background fog pattern. The chart in FIG. 15 includes multiple graphs GR1, GR2, GR3, GR4, and GR5, which connect different shape plots, represent the results of an experiment executed using the image forming units different in photoconductor running distance. As illustrated in FIG. 15, the characteristics represented by the graphs GR1, GR2, GR3, GR4, and GR5 are different depending on the image forming unit. In the image forming unit from which the graph GR1 (on the top in FIG. 16, connecting solid triangular plots) was derived, a large amount of background fog toner was generated with a relatively low background potential. This result suggests that the background fog easily occurs in that image forming unit since the developer has deteriorated and the toner charge amount per toner mass (Q/M) is lower, or the discharge start voltage is higher and the charging potential Vd is lower than the target charging potential. In such an image forming unit, to suppress the occurrence of background fog, it is necessary to increase the absolute value of the charging bias Vc (in the negative polarity) to rise the charging potential Vd.

By contrast, in the image forming unit from which the graph GR5 (on the bottom in FIG. 16, connecting outlined square plots) was derived, the amount of background fog toner was smaller even when the background potential was relatively high. This result suggests that the carrier adhesion easily occurs in that image forming unit since the discharge start voltage is relatively lower and the charging potential Vd is higher than the target charging potential. In such an image forming unit, to suppress the occurrence of carrier adhesion, it is necessary to reduce the absolute value of the charging bias Vc (in the negative polarity) to lower the charging potential Vd.

Figure 16:
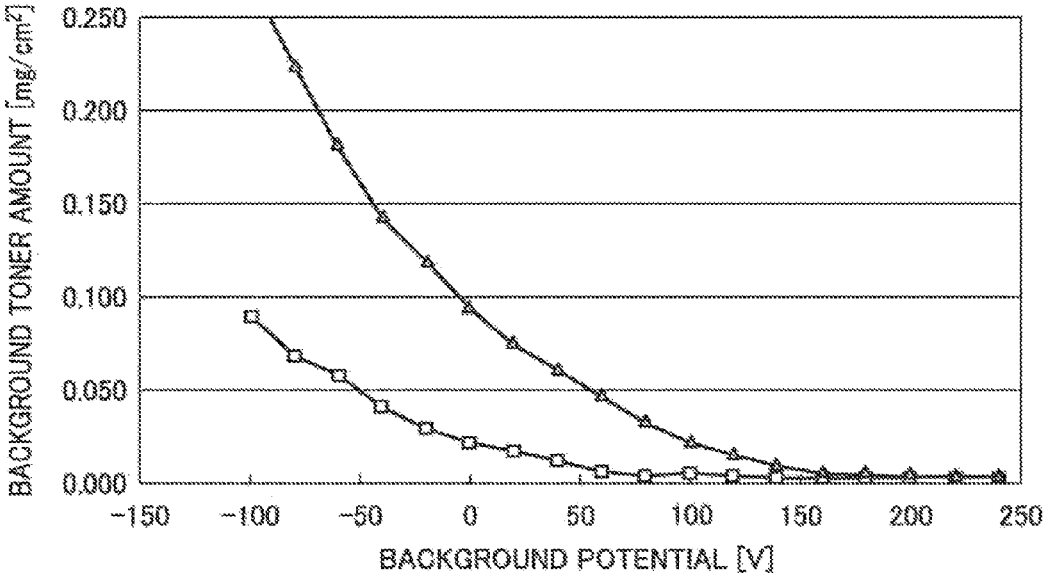
FIG. 16 is a chart illustrating characteristic curves between the background fog amount and the background potential and the inclination of straight lines approximated from the characteristic curves.

FIG. 16 is a chart illustrating characteristic curves between the background fog toner amount and the background potential and the inclination of straight lines approximated from the characteristic curves. FIG. 16 includes two characteristic curves representing the relation between the background fog toner amount and the background potential. Each of the two characteristic curves connects all plots regarding the image forming unit with which experiment data is derived. To compute the charging bias adjustment amount, not such a characteristic curve but the approximate straight line thereof is used. Of the approximate straight line, only a range in which the background fog amount is moderate is used, which is described in detail later. Accordingly, it is necessary to obtain an approximate straight line having a proper inclination in the range in which the background fog toner amount is moderate (hereinafter "moderate adhesion range"). However, if most of the characteristic curve extends in a range in which the background fog toner amount is relatively large (hereinafter "high adhesion range") like the upper graph, the characteristic curve rises on the high adhesion range side. In this case, in the moderate adhesion range, the approximate straight line has an inclination greater than an optimum value. If most of the characteristic curve extends in a range in which the background fog toner amount is relatively small (hereinafter "low adhesion range"), like the lower graph, the characteristic curve lies on the low adhesion range side. In this case, in the moderate adhesion range, the approximate straight line has an inclination smaller than the optimum value.

In view of the foregoing, from the group of sampled data values corresponding to each section of the background fog pattern, the controller 30 extracts only data values with which the background fog toner amount within a predetermined range (from a lower limit to an upper limit) is obtained. Then, the controller 30 computes the approximate straight line based on the extracted data values. It is to be noted that, in a case where the number of sampled data values is two or smaller, the controller 30 ends the charging bias adjustment since linear approximation is not available.

Figure 17:
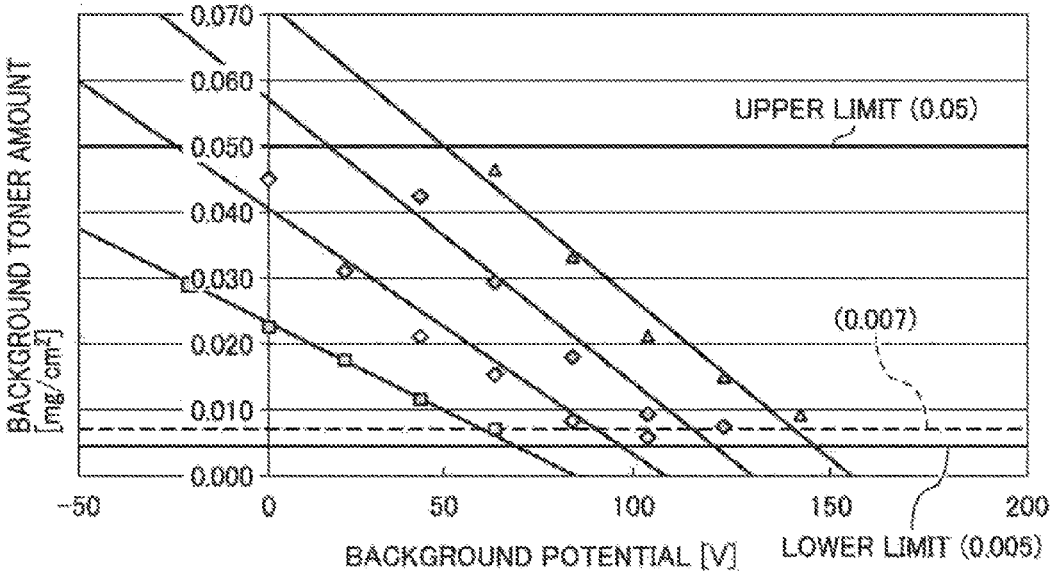
FIG. 17 is a chart illustrating relations between the approximate straight lines and extracted data values.
Figure 18:
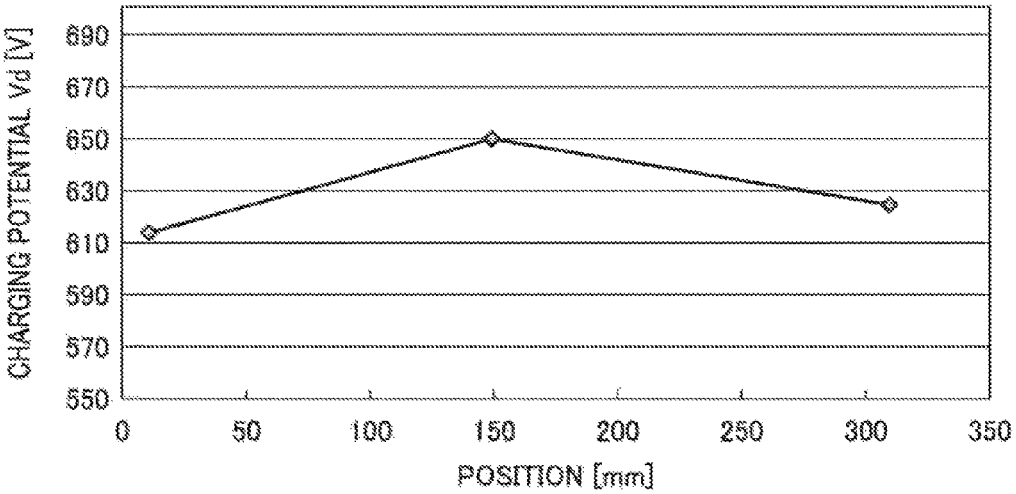
FIG. 18 is a graph illustrating a relation between the charging potential and axial position on a photoconductor that has been driven for a relatively long running distance.

FIG. 17 is a chart illustrating relations between the approximate straight lines and the extracted data values. In FIG. 18, four approximate straight lines are obtained based on four groups of extracted data values. In each approximate straight line (connecting plots of identical shape), the extracted toner adhesion amounts indicated by the extracted data values are within the range defined by the lower limit and the upper limit. In the present embodiment, the lower limit is 0.005 mg/cm$^2$, and the upper limit is 0.05 mg/cm$^2$.

Subsequently, based on the approximate straight line, the controller 30 determines a background potential that causes a limit-exceeding adhesion amount (indicated by broken lateral line in the drawing) as a limit-exceeding background potential $P_1$. The term "limit-exceeding adhesion amount" is an experimentally predetermined constant and means an adhesion amount slightly larger than the background fog toner amount that keeps the background fog density at a marginal of the tolerable range. The limit-exceeding adhesion amount is between the lower limit and the upper limit. In other words, the lower limit and the upper limit are determined so that the limit-exceeding adhesion amount is interposed therebetween. In the present embodiment, the limit-exceeding adhesion amount is 0.007 mg/cm$^2$ (indicated by broken lateral line).

After determining the limit-exceeding background potential $P_1$, the controller 30 computes a charging bias adjustment amount β according to $$\beta = P_1 - (P_2 - S_1),$$

where $P_2$ represents a theoretical background potential meaning a theoretical value of the background potential obtained from the charging potential Vd and the developing bias Vb determined in the previous process control, and $S_1$ represents a predetermined margin. The predetermined margin $S_1$ is a constant determined based on an experiment performed beforehand. The predetermined margin $S_1$ is deducted from the theoretical background potential $P_2$, thereby obtaining a theoretical limit-exceeding potential, which is a background potential to attain the limit-exceeding adhesion amount under the condition employing the theoretical background potential $P_2$. In other words, what obtained by deducting the margin $S_1$ from the limit-exceeding background potential $P_1$ is a background potential to keep the background fog toner amount reliably within the tolerable range in the current condition. In the formula presented above, the theoretical limit-exceeding potential is deducted from the limit-exceeding background potential $P_1$ to obtain the charging bias adjustment amount β, which is a correction amount to keep the charging potential Vd at or similar to the target charging potential.

The description here is made on the assumption that the inclination of the graph illustrated in FIG. 9, which represents the relation between the charging bias Vc and the charging potential Vd, is 1. When the inclination is 1, the change in the background potential as it is serves as the correction value of the charging bias. When the relation between the charging bias Vc and the charging potential Vd is different, for example, when the inclination of the graph illustrated in FIG. 9 is 2, the above-mentioned expression is modified to $\beta=2\times\{P_1-(P_2-S_1)\}$.

In the present embodiment, the margin $S_1$ is 90 V. Accordingly, in an example where the theoretical background potential $P_2$ is 160 V, the margin $S_1$ is 90 V, and the limit-exceeding background potential $P_1$ is 139 V, the charging bias adjustment amount β is obtained as $\beta=139-(160-90)=69$ V.

Subsequently, the controller 30 deducts the charging bias adjustment amount β from the charging bias Vc determined in the process control, thereby adjusting the charging bias Vc to a value capable of attaining the charging potential Vd identical or similar to the target charging potential. It is to be noted that, when the charging bias adjustment amount β is a positive value, the charging bias Vc is adjusted to a greater absolute value in the negative polarity. Thus, the background potential becomes greater, suppressing the occurrence of background fog. By contrast, when the charging bias adjustment amount β is a negative value, the controller 30 shifts the charging bias Vc to the positive side by the absolute value of the charging bias adjustment amount β. In other words, the charging bias Vc is reduced in absolute value. Then, the background potential becomes smaller, suppressing the occurrence of carrier adhesion.

As described above, in the present embodiment, the charging bias adjustment amount is determined as follows. Calculate the approximate straight line based on only the sampled data values between the lower limit and the upper limit, setting the limit-exceeding adhesion amount between the lower limit and the upper limit, and determining the charging bias adjustment amount β based on the limit-exceeding background potential $P_1$, the theoretical background potential $P_2$, and the margin $S_1$. In this configuration, even when the coordinates of all sampled data values representing the background fog toner amounts (hereinafter "sampled fog toner amounts") are out of the tolerable range of the background fog density, it is possible to calculate the charging bias adjustment amount β to keep the background fog density within the tolerable range. Accordingly, the background fog pattern is formed without increasing the background potential to a degree that causes carrier adhesion, thereby avoiding the occurrence of carrier adhesion in formation of the background fog pattern.

FIG. 18 is a graph illustrating a relation between the charging potential Vd and the position in the axial direction of the photoconductor 2 that has been driven for a relatively long running distance. This graph is plotted based on the values of the charging potential Vd measured by the reflective photosensors disposed at a 10-millimeter position, a 160-millimeter position, and a 310-millimeter position in the axial direction of the photoconductor 2 in a case where the image formation width is 320 millimeters, relative to an A3-size image width (300 millimeters). In the axial direction of the photoconductor 2, the charging potential Vd is lower in end areas than a center area. Accordingly, the possibility of background fog is higher in the end areas than the center area.

Figure 19:
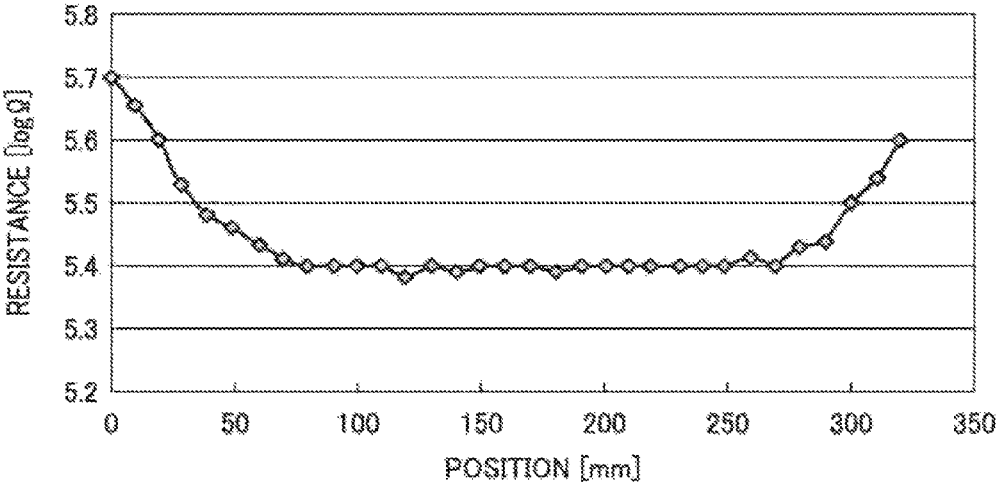
FIG. 19 is a graph illustrating a relation between electrical resistance of a charging roller and axial position on the charging roller in an image forming unit in which the photoconductor has been driven for a relatively long running distance.

FIG. 19 is a graph illustrating a relation between electrical resistance of the charging roller and the axial position on the charging roller in an image forming unit in which the photoconductor has been driven for a relatively long running distance. As the photoconductor running distance increases, ends of the charging roller 3 in the axial direction thereof are soiled with silica (an additive to toner), and the electrical resistance at the ends increases more than a center area. Therefore, the charging potential Vd varies between the 10-millimeter position, the 160-millimeter position, and the 310-millimeter position in the axial direction of the photoconductor 2.

In view of the foregoing, in the present embodiment, a combination of the background fog pattern and the toner image for locating of each color is formed in the end areas in the belt width direction, which correspond to the axial end areas of the photoconductor 2 and the charging roller 3. More specifically, for each of yellow, cyan, magenta, and black, the combination of the background fog pattern and the toner image for locating is formed on either the first end side facing the first reflective photosensor 20*a* or the second end side facing the fourth reflective photosensor 20*d* in the belt width. With this placement, the occurrence of background fog is detected at a higher sensitivity.

Preferably, the above-mentioned combination regarding each color is formed in both of the first and second end sides in the belt width direction, the toner adhesion amount is detected in each section of the background fog pattern on both end sides, and the mean value is obtained. With this configuration, the charging bias adjustment amount β is computed more properly.

In the present embodiment, the charging bias Vc ascends stepwise, as illustrated in FIG. 13, in forming the background fog pattern. That is, the absolute value of the charging bias is changed stepwise from a greater value to a smaller value, and the background potential is reduced stepwise. Since the charging bias Vc is in the negative polarity, the absolute value thereof increases as the charging bias Vc descends in FIG. 14. That is, by the setting of the charging bias Vc, the background fog pattern section is formed on the photoconductor 2 sequentially from the section in which the background fog toner amount is smaller. The occurrence of background fog means that, though the amount is small, toner is consumed, and the toner concentration in the developer decreases. Sequentially forming the background fog pattern sections on the photoconductor 2 from the section in which the background fog toner amount is small is intended to gradually lower the toner concentration in the process of forming the background fog pattern from the leading end to the trailing end. This configuration is advantageous in making the background fog amount accord with that section without being affected by decreases in toner concentration and detecting the background fog property accurately. Additionally, the toner image for locating, which requires a greater amount of toner, is formed on the back of the background fog pattern in the belt travel direction so that the toner image for locating is developed after the trailing end of the background fog pattern is developed. This is advantageous in avoiding decreases in detection accuracy of the background fog property caused by decreases in toner concentration inherent to developing of the toner image for locating.

Figure 20:
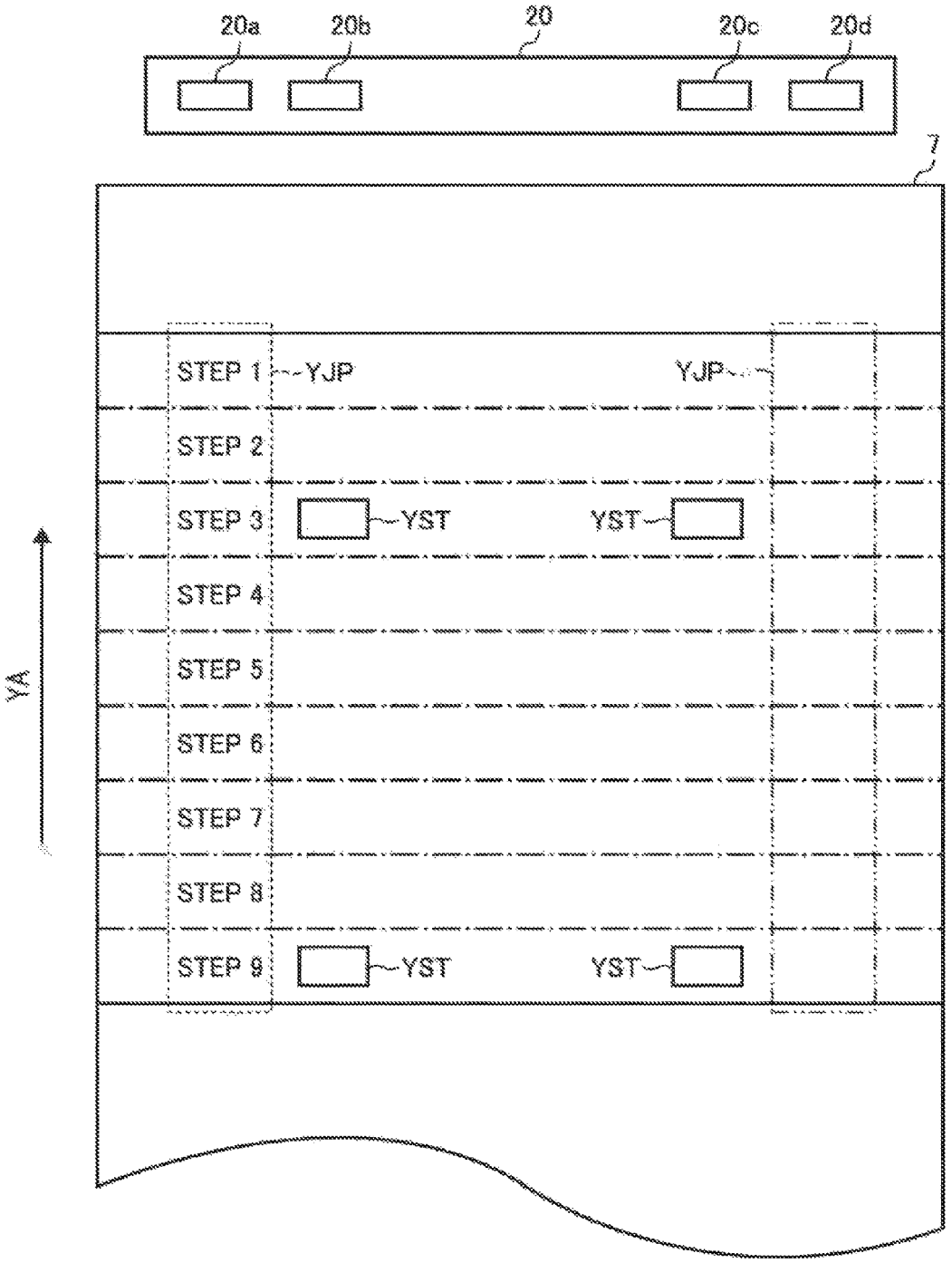
FIG. 20 is a plan view illustrating a variation of the yellow background fog pattern on the intermediate transfer belt.

Additionally, it is not essential that the toner image for locating is disposed on the front or back of the background fog pattern in the belt travel direction. For example, as illustrated in FIG. 20, the yellow toner image YST for locating can be on the side of the yellow background fog pattern YJP in the belt width direction. In the illustrated example, the yellow toner image YST for locating is disposed on the side of the yellow background fog pattern YJP disposed on the first end side in the belt width direction to pass through the position detected by the first reflective photosensor 20*a*. Based on the timing at which the yellow toner image YST for locating arrives at the position detected by the second reflective photosensor 20*b*, the controller 30 determines the timing at which each section of the yellow background fog pattern YJP on the first end side arrives at the position detected by the first reflective photosensor 20*a*. The controller 30 further determines the timing at which each section of the yellow background fog pattern YJP on the second end side arrives at the position detected by the fourth reflective photosensor 20*d*. In this configuration, the arrival timing of each section can be determined more accurately.

Embodiment 1

Next, descriptions are given below of a distinctive feature of the image forming apparatus according to the present embodiment.

During the above-described charging bias adjustment, image formation according to user instructions is not feasible since the background fog pattern is formed with the charging bias Vc changed stepwise. Accordingly, the downtime of the apparatus increases as the charging bias adjustment is performed. The apparatus may be configured to execute the charging bias adjustment when both of Condition 1: the photoconductor running distance reaches a threshold (e.g., 10 km) and Condition 2: temperature falls to or below a threshold (e.g., 10° C.) or absolute humidity is not proper, are satisfied. In the following case, however, necessity of charging bias adjustment is small even when temperature is relatively low (e.g., 6° C.) or absolute humidity is not proper (too low or too high). That is, necessity of charging bias adjustment is small in a case where the previous charging bias adjustment has been performed under the similar temperature or humidity, and the change in temperature or absolute humidity from the previous charging bias adjustment is relatively small.

In view of the foregoing, in the present embodiment, the controller 30 stores, in the RAM 30*b*, the detection result (i.e., environment data) detected by the environment detector 52 during the previous charging bias adjustment. In the step of determining whether to execute the charging bias adjustment, the controller 30 determines not to execute the charging bias adjustment in the following case even when the temperature is relatively low or absolute humidity is not proper. That is, the charging bias adjustment is not to be executed in the case where the environment change amount (change in temperature or absolute humidity) from the previous charging bias adjustment is relatively small. Such determination can suppress the occurrence of downtime caused by unnecessary execution of charging bias adjustment.

Figure 21:
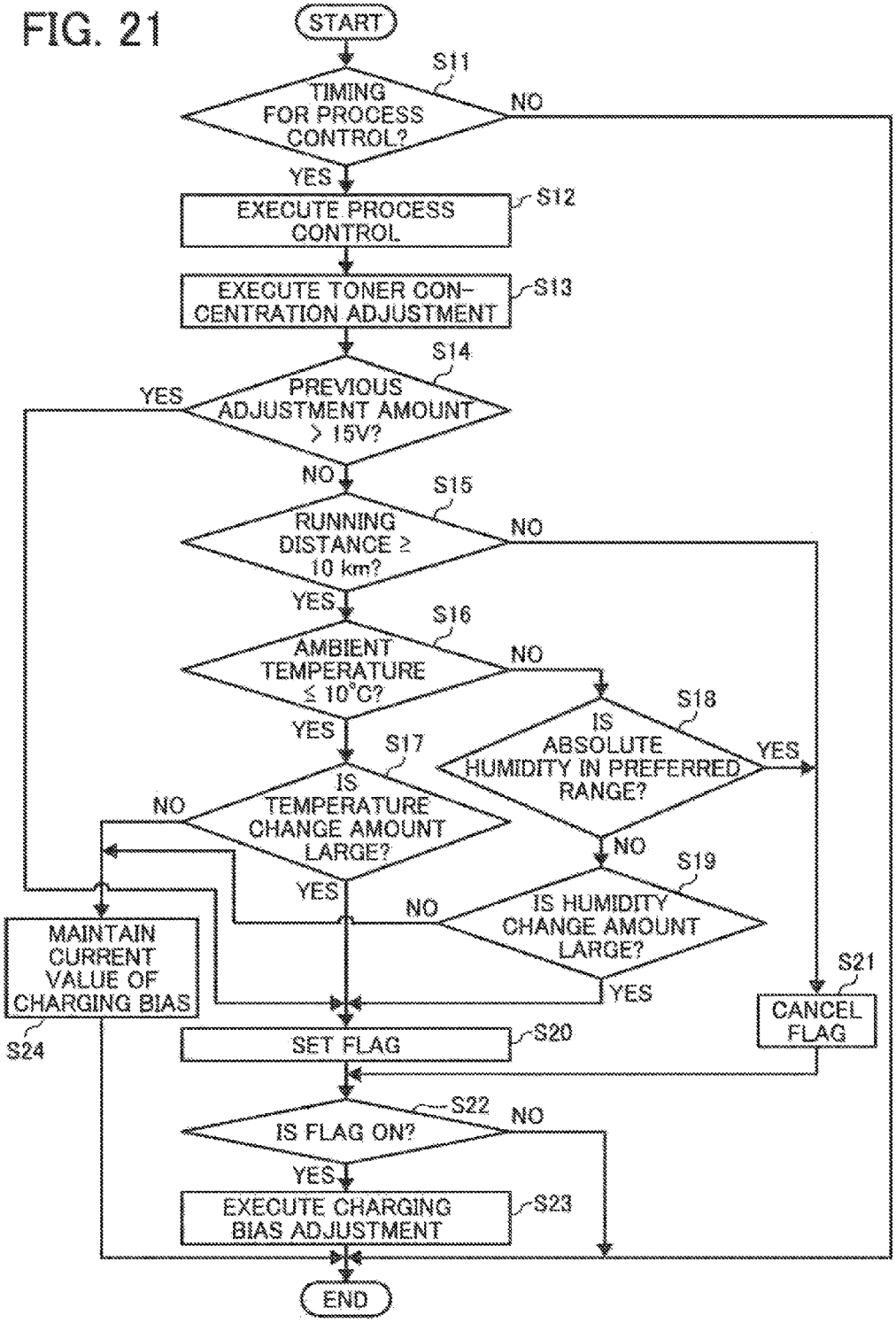
FIG. 21 is a flowchart of regular routine processing of a controller of the image forming apparatus illustrated in FIG. 1.

FIG. 21 is a flowchart of regular routine processing of the controller 30 according to the present embodiment. In the regular routine processing, at S11, the controller 30 determines whether or not the predetermined timing for process control has arrived. When it is not the predetermined timing for process control (No at S11), the regular routine processing completes. When it is the predetermined timing for process control (Yes at S11), the process proceeds to step S12.

At S12, the controller 30 executes the above-described process control. It is to be noted that, when consecutive printing is ongoing, the printing is suspended, and then the process control is started.

After the process control, at S13 the controller 30 executes toner concentration adjustment in which the toner concentration of developer contained in each of the developing devices 4Y, 4C, 4M, and 4K is adjusted. Since the target toner concentration is changed in the process control in some cases, the toner concentration is adjusted after the process control. When the current toner concentration is lower than the target concentration, toner is supplied to the developer in the developing device 4. When the current toner concentration is higher than the target concentration, a toner image for toner consumption is developed, thereby forcibly consuming toner.

After the toner concentration adjustment completes, the controller 30 determines whether or not the charging bias adjustment is necessary. At S14, the controller 30 determines whether the previous charging bias adjustment amount is greater than the threshold (e.g., 15 V) from the following reason. Differently from the process control in which the patch pattern toner images are detected, in the charging bias adjustment, the amount of toner adhering to the background, which is an area of the photoconductor where the amount of toner adhering is very small. Accordingly, it is possible that the toner adhesion amount detector sensitively detects toner adhering to the background due to a sporadic factor not directly correlated with the background potential, for example, toner scattering, and the charging bias Vc is adjusted by an unnecessarily large amount. In such a case, carrier adhesion is caused. Generally, since deviation of the charging potential Vd from the target is gradual, significant adjustment of the charging bias Vc is rare. Such significant adjustment is often a result of detection of the toner adhering to the background of the photoconductor due to such a sporadic factor, and probably the adjustment amount is unnecessarily large. Such a case is hereinafter referred to as "unnecessary adjustment". Therefore, when the adjustment amount is greater than 15 V (Yes at S14), the process proceeds to step S20, in which a flag is set, to perform the charging bias adjustment regardless of the environment. When the flag is on (Yes at S22), the controller 30 determines to perform the current charging bias adjustment at S23. With this operation, in a case where the charging potential Vd is excessively high because the previous charging bias adjustment is "unnecessary adjustment", the charging potential Vd is reduced to a proper value. Accordingly, unnecessary degradation of the photoconductor can be suppressed. This operation can promptly inhibit the occurrence of carrier adhesion due to excessively high charging potential.

When the charging bias adjustment is executed, the controller 30 stores, in the RANI 30*b*, the charging bias adjustment amount, temperature detected by the environment detector 52, and absolute humidity at that time.

By contrast, when the previous charging bias adjustment amount is smaller than 15 V (No at S14), at S15, the controller 30 determines whether the photoconductor running distance from the previous execution of charging bias adjustment is greater than or equal to the threshold (e.g., 10 km) from the following reason. It is experientially known that the charging potential Vd deviates from the target charging potential determined in the process control when the photoconductor running distance reaches a certain threshold and that the deviation is ignorable until the photoconductor running distance reaches the threshold. Therefore, when the photoconductor running distance is smaller than the threshold, for example, 10 km (No at S15), at S21, the controller 30 cancels the flag and proceeds to Step S22.

Also known experientially is that, even when the photoconductor running distance reaches the threshold, the deviation of the charging potential Vd from the target charging potential is relatively small depending on the environment. Specifically, when the temperature is at or lower than a certain threshold temperature, the deviation is large, requiring charging bias adjustment. Further, even when the temperature is higher than the threshold temperature, the deviation is large if the absolute humidity is out of the preferred range. Then, the charging bias Vc needs to be adjusted. However, necessity of charging bias adjustment is small in the case where the change in temperature or absolute humidity from the previous charging bias adjustment is relatively small, even when the temperature is at or lower than the threshold or the absolute humidity is out of the proper value.

Accordingly, when the photoconductor running distance is equal to or greater than 10 km (Yes at S15), the controller 30 proceeds to S16, at which the controller 30 determines whether or not the ambient temperature is equal to or lower than the threshold temperature (e.g., 10° C.). When the ambient temperature is smaller than or equal to 10° C. (Yes at S16), at S17, subsequently the controller 30 compares the environment data (e.g., temperature) generated in the previous charging bias adjustment, stored in the RAM 30*b*, with the environment data currently transmitted from the environment detector 52 and determines whether or not the change in temperature from the previous charging bias adjustment is greater than or equal to a threshold. When the temperature change is greater than or equal to the threshold (Yes at S17), at S20, the controller 30 sets the flag. For example, the threshold of temperature change is 2° C. or greater.

By contrast, when the temperature is higher than 10° C. (No at S16), at S18, the controller 30 determines whether or not the absolute humidity is in the preferred range. When the absolute humidity is out of the preferred range (No at S18), at S19, subsequently the controller 30 determines whether or not the change in absolute humidity from the previous charging bias adjustment is greater than or equal to the threshold. When the humidity change is greater than or equal to the threshold (Yes at S19), at S20, the controller 30 sets the flag. For example, the threshold of humidity change is 2 $mg/m^3$ or greater.

Even when the temperature is at or lower than 10° C. or the absolute humidity is out of the preferred range, in a case where the temperature change or humidity change is smaller than the threshold (No at S17 or S19), the process proceeds to S24. Then, the charging bias is not adjusted, but the current value is maintained. Then, the regular routine processing is completed. Such processing can suppress increases in downtime caused by unnecessary execution of charging bias adjustment. When the absolute humidity is within the preferred range (Yes at S18), at S21, the flag is canceled, and the process proceeds to S22.

At S22, the controller 30 determines whether the flag is on or off. When the flag is on (Yes at S22), at S23, the charging bias adjustment is performed, and the regular routine processing is completed. When the flag is off (No at S22), at S23, the regular routine processing is completed without adjusting the charging bias.

In the present embodiment, 15 V is used as the threshold to determine whether or not the previous charging bias adjustment amount is large because the inventors have experimentally found that the incidence of "unnecessary adjustment" reaches 10% in the case of 15 V. Alternatively, the threshold can be a value with which the incidence is higher or smaller than 10%.

In the above-described embodiment, if the charging bias adjustment amount is too large, inconveniences in output images may occur. For example, thicknesses of thin lines or the image density of a halftone portion may vary significantly between before and after the charging bias adjustment. In view of the foregoing, the inventors performed an experiment in which 16-level gradation pattern images were formed by area coverage modulation, and color difference ΔE thereof was measured.

The color difference ΔE was measured as follows. Using a test printer, 16-level gradation pattern images of cyan and magenta were printed on white paper. Subsequently, the charging bias Vc was changed by 50 V from the setting in the previous printing, and the 16-level gradation pattern images of cyan and magenta were again printed. In the 16-level gradation pattern images, the 16th gradation portion is a solid image having an image area rate of 100%, and the area inside a rectangular outline is fully filled with toner. The 15th gradation portion, the 14th gradation portion, the 13th gradation portion, the 12th gradation portion, the 11th gradation portion, and the 10th gradation portion have image area rates of 93.75%, 87.50%, 81.25%, 75.00%, 68.75%, and 62.50%, respectively. The 9th gradation portion, the 8th gradation portion, the 7th gradation portion, the 6th gradation portion, the 5th gradation portion, and the 4th gradation portion have image area rates of 56.25%, 50.00%, 43.75%, 37.50%, 31.25%, and 25.00%, respectively. The 3rd gradation level, the 2nd gradation level, and the 1st gradation level have image area rates of 18.75%, 12.50%, and 6.25%, respectively. From the 15th gradation level through the 1st gradation level, the image area rate is reduced by 6.25% as the gradation number (gradation level) decreases by one.

Using X-Rite 938 or X-Rite 939 from X-Rite Inc., the color difference ΔE in L*a*b* color space was examined between the gradation pattern images printed before and after changing the charging bias Vc. Instead of the above-mentioned measuring instruments, other measuring instruments having similar capabilities can be used.

Figure 22:
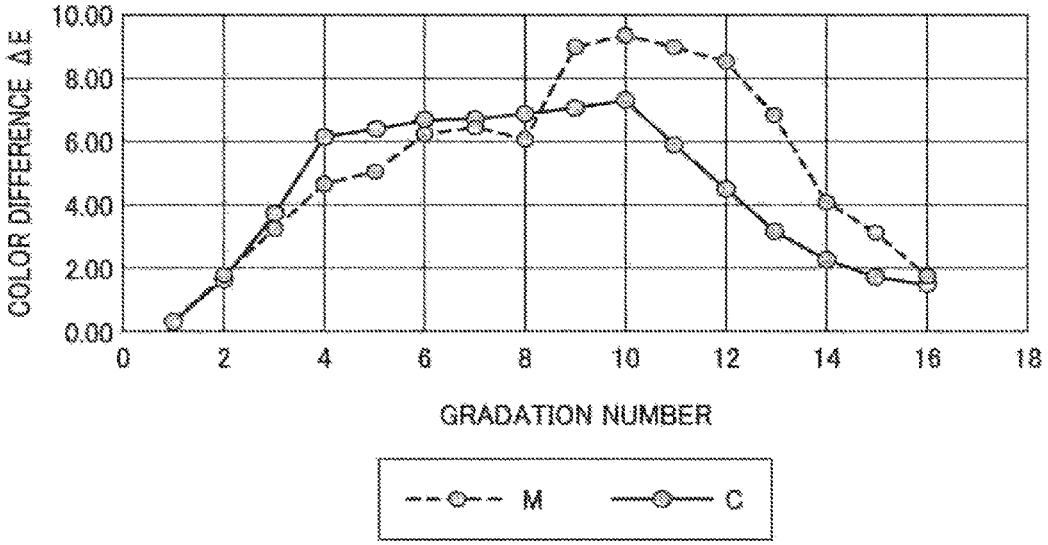
FIG. 22 is a chart illustrating relations between color difference ΔE and a gradation number of 16-level gradation pattern images in an experiment.

FIG. 22 is a chart illustrating relations between the color difference ΔE and the gradation number of the gradation pattern images in the experiment. As illustrated in the chart, regarding cyan and magenta, the color difference ΔE between before and after changing the charging bias Vc is relatively small at the 1st gradation level, the 2nd gradation level, the 3rd gradation level, and the 16th gradation level. In case of cyan, the color difference ΔE is relatively large at the 4th gradation through 10th gradation. In case of magenta, the difference is relatively large in the 9th gradation through the 12th gradation. In such gradation ranges, image density as well varies significantly between before and after changing the charging bias Vc. When thin-line images in such gradation ranges were formed before and after changing the charging bias Vc and were compared, significant variations in line thickness were recognized.

Figure 23A:
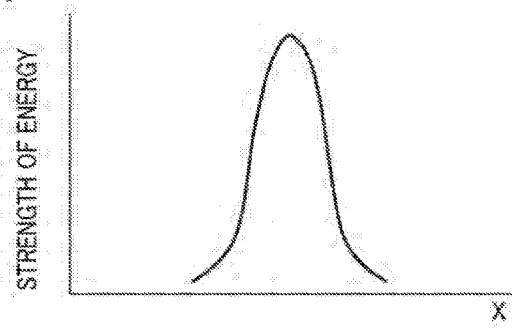
FIG. 23A is a graph illustrating a relation between the energy of light beam and beam spot position in the radial direction of the light beam.
Figure 23B:
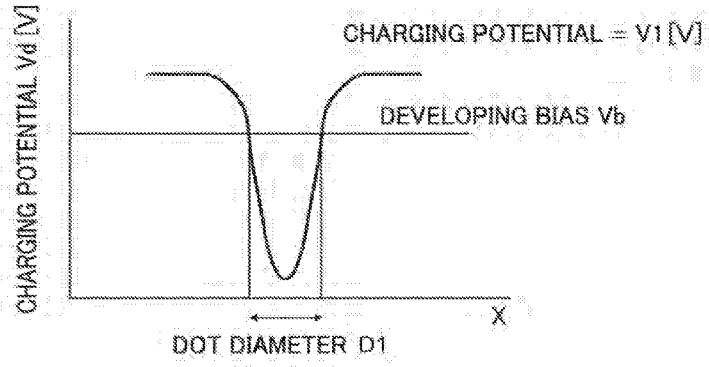
FIG. 23B is a graph illustrating the distribution of exposed-area potential when the charging potential is V1 volt.
Figure 23C:
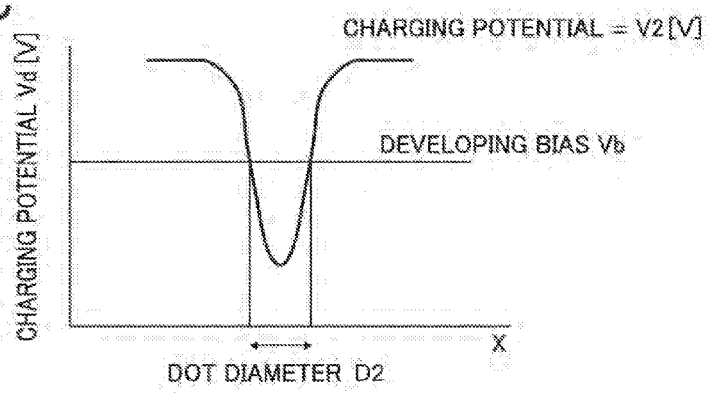
FIG. 23C is a graph illustrating the distribution of exposed-area potential when the charging potential is V2 volt.

Conceivably, the variations in color difference ΔE, line thickness of thin lines, and image density were caused as follows. Referring to FIG. 23A, in which the X-axis represents a position in the radial direction of a light beam spot to write one dot on the photoconductor, the energy of the beam is strongest at the center of the spot in the redial direction of the beam spot. The energy gradually decreases as the position deviates from the center to the outer side in the radial direction. When the photoconductor charged to have a potential of V1 volt (i.e., charging potential Vd−V1) is irradiated with such a light beam, the irradiated portion attains the potential distribution illustrated in FIG. 23B, due to the effect of the light beam energy distribution and sensitivity characteristics of the photoconductor. In an electrophotographic process, toner adheres to, of the surface of the photoconductor, a portion having a potential smaller in absolute value than the developing bias Vb. Accordingly, when attention is given to one dot, the dot diameter is D1 in the example illustrated in FIG. 23B. By contrast, assuming that the charging potential Vd is increased to V2 volt (|V1|<|V2|), as illustrated in FIG. 23C, in the beam spot, the portion where the potential is smaller than the developing bias Vb becomes smaller. As a result, the dot diameter decreases to D2 smaller than D1.

When the charging bias Vc is adjusted with an extremely large adjustment amount in the charging bias adjustment, the charging potential Vd changes significantly. Accordingly, the dot diameter significantly changes between before and after adjusting the charging bias Vc. Therefore, in the gradation portion by area coverage modulation, even if the dot number is identical, image density varies because the rate of area occupied by the dot varies. Regarding thin lines, the line width significantly varies between before and after adjusting the charging bias. Additionally, in a secondary-color portion formed by superimposing two different primary-colors (yellow, cyan, magenta, and black) or a tertiary-color portion formed by superimposing three different primary-colors, the color or chromaticity varies significantly between before and after adjusting the charging bias because the color differences ΔE of the primary colors change wildly.

The developing bias Vb may be changed in accordance with increases or decreases in the charging potential Vd to suppress such inconveniences. In doing so, however, background fog or carrier adhesion can be caused since changing the background potential is not feasible.

The inventors performed a second print test using the test printer. In the second print test, regarding magenta, a halftone toner patch corresponding to the 10th gradation level of the 16-level gradation was formed before and after changing the charging bias Vc, and the color difference ΔE between before and after the changing was measured. That is, the 10th gradation at which the color difference ΔE was largest was focused. After changing the charging bias Vc, the color of the halftone toner patch was measured at Timing 1: immediately after changing the charging bias Vc, and Timing 2: after the halftone toner patch was output on a predetermined number of sheets, and the color difference ΔE from the toner patch before the changing was calculated in each of the two timings. Regarding the change amount of the charging bias Vc, five amounts of −50 V, −30 V, 0 V, 30 V, and 50 V were applied.

Figure 24:
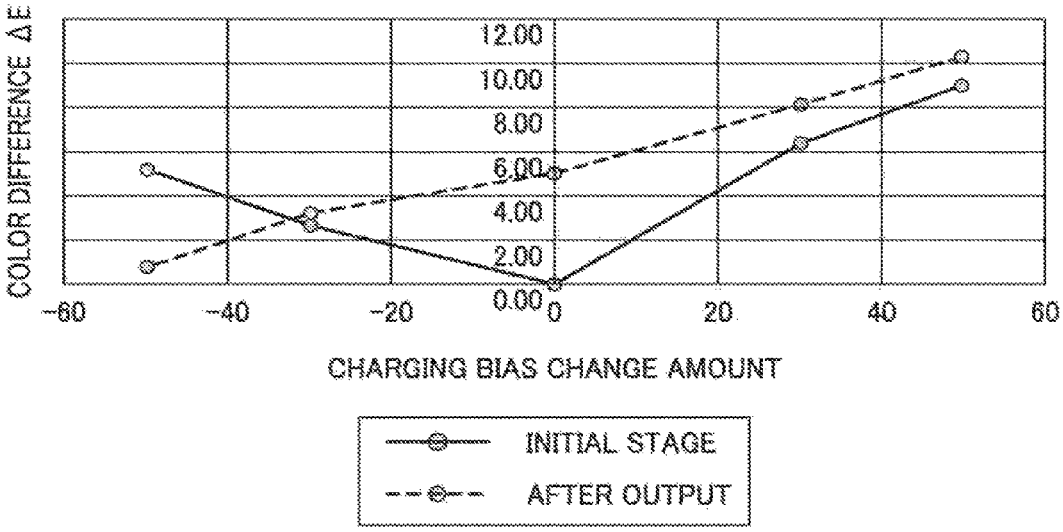
FIG. 24 is a graph illustrating relations between color difference ΔE and a charging bias change amount in a second print test.

FIG. 24 is a graph illustrating relations between the color difference ΔE and the change amount of the charging bias Vc in the second print test.

As illustrated in the graph, the maximum color difference ΔE in the second test print is slightly greater than 10. The maximum difference occurred after the predetermined number of sheets was consecutively output after the charging bias Vc was changed by 50 V. From another experiment, the inventors have found that, when the color difference ΔE is smaller than or equal to 10, the variations in the color (or chromaticity), thin-line with, and image density, caused by the charging bias adjustment, can be kept in or on the verge of allowable ranges. According to FIG. 24, the color difference ΔE is kept smaller than or equal to 10 when the upper limit of the adjustment amount in the charging bias adjustment is set to 30 V (hereinafter "maximum adjustment amount").

When the controller 30 is configured to impose the maximum adjustment amount thus obtained on the adjustment amount in the charging bias adjustment, the variation in each of color (or chromaticity), thin-line with, and image density can be kept in the allowable range. Specifically, the maximum adjustment amount is obtained as follows. Perform a test print of 16-level gradation pattern, measure the color difference ΔE from the gradation pattern image before adjusting the charging bias regarding each of Timing 1: immediately after changing the charging bias Vc, and Timing 2: after the predetermined number of sheets are output. Obtain a maximum adjustment amount to keep the color difference ΔE smaller than or equal to an allowable limit at each of the 4th through 12th gradation levels. Then, the controller 30 is configured to adjust the charging bias Vc within the maximum adjustment amount. Needless to say, alternatively, the maximum adjustment amount can be such a value that keeps the color difference ΔE smaller than or equal to an allowable limit at each of the 16 gradation levels. Although experiment results of only cyan and magenta are presented above, similar results were obtained regarding yellow. Regarding black, results of thin-line thickness and image density were similar to those of yellow, cyan, and magenta.

Therefore, in the printer 100 according to the present embodiment, the controller 30 is configured to adjust the charging bias Vc, in the charging bias adjustment, within the maximum adjustment amount of 30 V, which is an absolute value and either +30 V or −30 V.

According to the Embodiment 1, the occurrence of downtime of the apparatus caused by charging bias adjustment performed unnecessarily can be inhibited.

Next, descriptions are given below of examples (Embodiments 2-1 through 2-4) to which a distinctive feature is added to the printer according to above-described embodiment. Other than the differences described below, the printer according to Embodiments 2-1 through 2-4 are similar to that according to Embodiment 1.

Embodiment 2-1

Currently, in production printing, there arise demands for restricting the color difference ΔE to 5 or smaller and, more preferably, to 3 or smaller so that the production printer replaces with a conventional offset printer. An object of Embodiment 2-1 is to meet such demands.

In the printer 100 according to Embodiment 2-1, a conversion table used in tone reproduction (gradation reproduction) is modified, as required, immediately after the charging bias adjustment is performed. To modify the conversion table, initially, a predetermined gradation pattern image is formed by area coverage modulation, and the image density (toner adhesion amount) of each gradation level of the gradation pattern image is detected. Based on the amount of deviation from the target image density at each gradation level, the conversion table, which represents a tone reproduction condition, is modified to attain the target image density at each gradation level. Input data in the conversion table is a gradation value of each pixel for each primary color (pixel value for each primary color). The input data is converted to a gradation value with which the target image density is attained, and the converted value is output. According to the conversion table, the gradation value of each pixel of image data is converted, and an image is formed according to the converted gradation values. Then, the target image density is attained. The gradation value of each primary color pixel is represented in 256 levels, one of 0 through 255.

Generally, as image forming performance changes with time, the actual image density does not linearly change relative to gradation change data ranging from 0 to 255. For example, as indicated by the graph labeled "before adjustment" in FIG. 25, the changes draw a curved graph. Accordingly, the conversion table is modified to convert the curved graph, such as the graph labeled "before adjustment" in FIG. 25, to a linear graph. When such modification is performed immediately after the charging bias adjustment as illustrated in the drawing, the limit of the color difference ΔE can be restricted to 5 or 3, which is stricter than 10.

Figure 26:
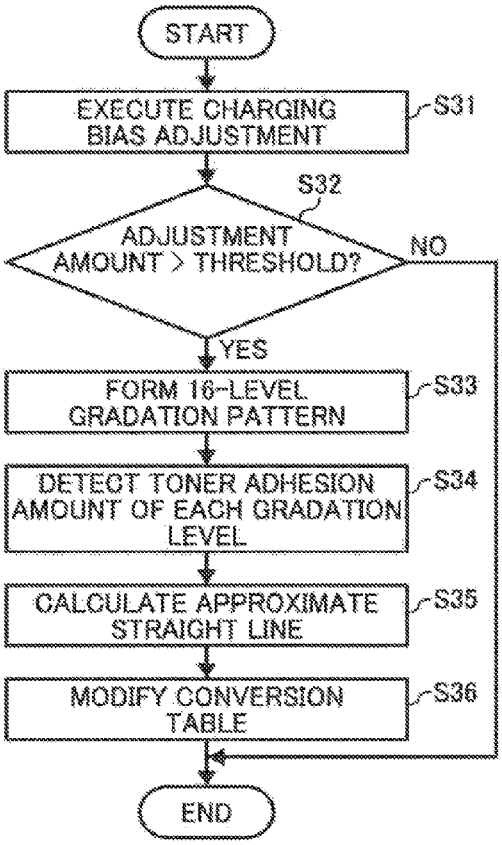
FIG. 26 is a flowchart of control process performed by a controller of an image forming apparatus according to Embodiment 2-1.

FIG. 26 is a flowchart of control process performed by the controller 30 of the printer 100 according to Embodiment 2-1. The control process illustrated in FIG. 26 is triggered when the condition to start the charging bias adjustment is satisfied. After the charging bias adjustment (i.e., preceding adjustment) is executed at S31, at S32, the controller 30 determines whether or not the adjustment amount in the preceding charging bias adjustment (S31) is greater than the threshold. The threshold is preset experimentally to a value to keep the color difference ΔE not greater than 5 or 3, to attain high quality. If the adjustment amount in the preceding charging bias adjustment is greater than the threshold, the printer 100 is not in the state to keep the color difference ΔE within the allowable range for high quality. Accordingly, when the preceding adjustment amount is greater than the threshold (Yes at S32), steps S33 through S36 are performed to modify the conversion table. By contrast, when the preceding adjustment amount is not greater than the threshold (No at S32), the process is completed.

Figure 25:
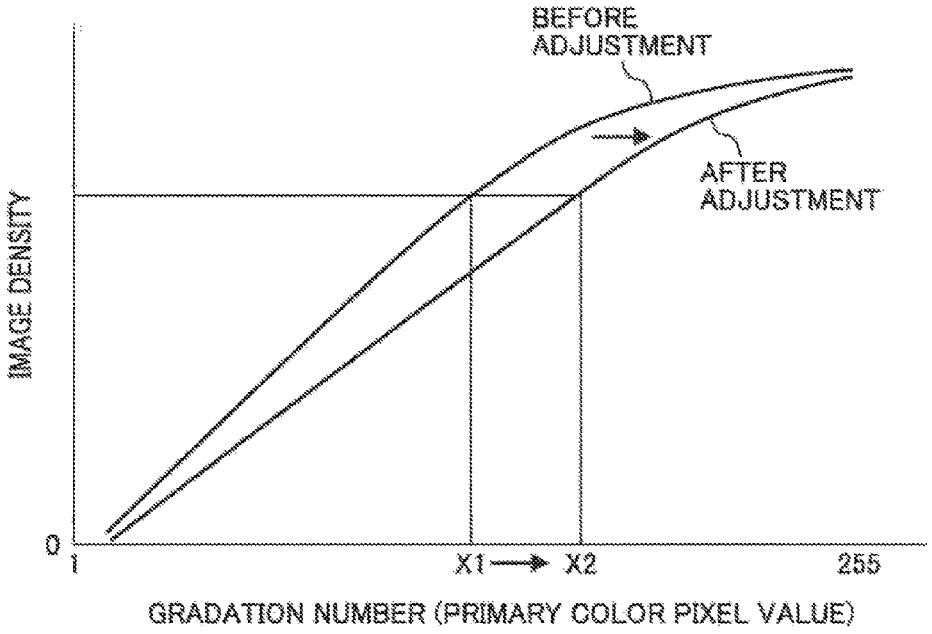
FIG. 25 is a graph illustrating a relation between image density and gradation (tone) value.

To modify the conversion table, at S33, a 16-level gradation pattern image is formed by area coverage modulation. At S34, the optical sensor unit 20 detects the image density (toner adhesion amount) of each gradation level of the gradation pattern image. At S35, the controller 30 calculates an approximate straight line that represents a linear graph characteristic as the relation between image density and gradation number, like the graph labeled "after adjustment" in FIG. 25. At S36, the controller 30 modifies the conversion table based on the approximate straight line. The process described above is performed for each of yellow, cyan, magenta, and black. With the modified conversion table, for example, as illustrated in FIG. 25, a given image density value processed with a gradation number X1 before is to be processed with a gradation number X2. Thus, the color difference ΔE can be restricted to, for example, 3 or 5, to attain high-quality images.

Figure 27:
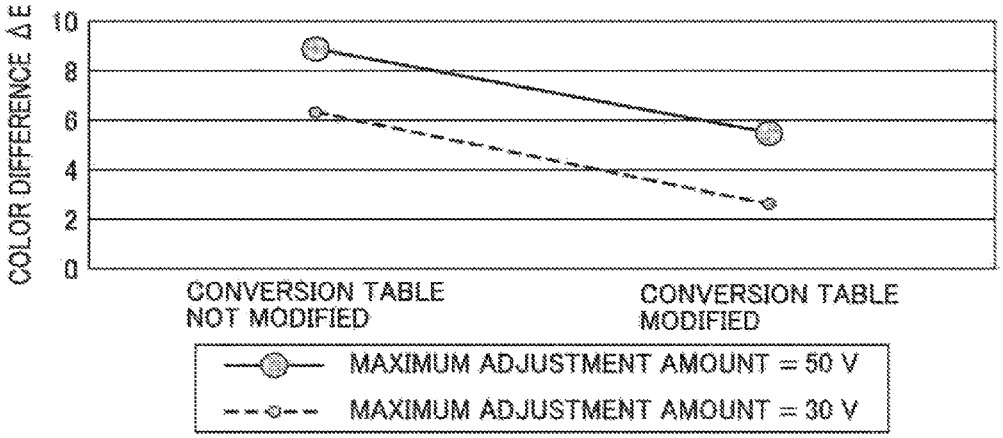
FIG. 27 is a graph illustrating a relation among the presence or absence of conversion table modification, the maximum of color difference ΔE in test print, and the maximum adjustment amount in the charging bias adjustment.

FIG. 27 is a graph illustrating a relation among the presence or absence of conversion table modification, the maximum of color difference ΔE in test print, and the maximum adjustment amount in the charging bias adjustment. As illustrated in the drawing, when the conversion table is not modified, the maximum color difference ΔE corresponds to the maximum adjustment amount of the charging bias Vc (for standard quality, color difference not greater than 10). By contrast, when the conversion table is modified, the maximum color difference ΔE can correspond to high quality.

Although the 16-level gradation pattern by area coverage modulation is used to modify the conversion table in Embodiment 2-1, the number of gradations is not limited thereto. In one embodiment, the number of gradations is greater than 16. In yet another embodiment, a gradation pattern having only the 4th through 12th gradation levels, in which the color difference ΔE is particularly large, is formed. Yet in another embodiment, in a case where the charging bias adjustment amount exceeds the threshold in at least one of yellow, cyan, magenta, and black, the conversion table is modified for each of the four colors.

It is to be noted that, although modifying the conversion table does not reduce variations in thin-line width, in another embodiment, the line width is adjusted corresponding to the amount of change in gradation value, which is an adjustment operation referred to as "line-width correction". For example, when the gradation value is changed from X1 to X2 as in FIG. 25, the line width is corrected corresponding to the difference "X2−X1". When a given line width is represented by one dot in an original image data, the number of dots of the line width is corrected to correspond to the difference "X2−X1". With this correction, variations in thin-line width can be restricted in an allowable range for high quality. The number of dots with which the line width is corrected corresponding to the difference in gradation value differs depending on machine specifications. Accordingly, the adjustment amount of the charging bias Vc, the change amount in gradation value, and variations in line width are measured in an experiment. Based on the results of the experiment, an algorithm is constructed to obtain the correction amount of line width from the change amount in gradation value.

Embodiment 2-2

In the above-described embodiment, the charging bias adjustment is not to be executed in the case where changes in the environment (i.e., environment change amount) from the previous charging bias adjustment are small. In a case where the environment changes sharply, however, frequent execution of the charging bias adjustment may be preferable. An example of such a rare situation is that, in the morning in a cold district, the main power of the image forming apparatus is turned on in a state in which the apparatus is cold, and the room temperature reaches a suitable temperature due to heating after the process control completes. In such a situation, since the temperatures of the charging device and the photoconductor rise rapidly simultaneously with startup of the apparatus, the charging bias adjustment is preferably performed regularly in relatively short intervals.

In view of the foregoing, in the printer 100 according to Embodiment 2-2, the controller 30 stores, in the RAM 30*b*, the temperature detected by the environment detector 52 and the calculated absolute humidity at regular timings, for example, each time a predetermined duration of time elapses or the number output sheets reaches a predetermined number. When the change in the temperature or the absolute humidity from the value stored previously is greater than or equal to a threshold, the charging bias adjustment is executed. At that time, when a print job is ongoing, the charging bias adjustment is started after the print job is completed. With this process, in the case of a sharp change in the environment, the charging bias adjustment is executed at a proper timing to suppress the occurrence of background fog and carrier adhesion resulting from the sharp change in the environment.

Embodiment 2-3

As described above, in typical image forming apparatuses employing electrophotography, when the maximum adjustment amount of the charging bias Vc is set to the value to restrict the color difference ΔE smaller than or equal to 10, variations (i.e., variations in color, thin-line width, and image density) caused by the charging bias Vc can be kept in the allowable ranges. In production printing industry, however, there is a more strict demand for image quality. To meet such a demand, the charging bias adjustment is preferably performed to inhibit the color difference ΔE from growing with elapse of time.

In view of the foregoing, in Embodiment 2-3, the input device 53, illustrated in FIG. 3, is connected to the controller 30 to input data to the controller 30. The input device 53 inputs, to the controller 30, coefficient data, as a correction data to correct the maximum adjustment amount. When a user inputs the correction data thereto, the controller 30 stores the correction data in the RAM 30*b*. In the charging bias adjustment, the controller 30 does not apply the maximum adjustment amount stored in the RANI 30*b* but applies a corrected maximum adjustment amount, corrected with multiplication using the coefficient data.

In this configuration, the upper limits of the variations in color, thin-line width, and image density can be changed to meet user preferences. It is to be noted that examples of the input device 53 include a control panel of the image forming apparatus and an element that accepts data input from computers.

Embodiment 2-4

Embodiment 2-4 concerns an image forming system including a management device and multiple image forming apparatuses (e.g., printers) of same type, capable of communicating with the management device. Currently, there are management systems in which multiple image forming apparatuses can communicate with a management device via a network and data are collected to the management device to predict fault or malfunction of the apparatus, to manage charging (billing), or the like. Via a network such as the Internet, operation data of the multiple image forming apparatuses is transmitted to the management device at a predetermined timing, and the management device analyzes the operation data and performs management work such as failure prediction, charging, and the like.

In the image forming system according to Embodiment 2-4, the multiple image forming apparatuses and the management device are configured to communicate with each other for such management works.

Figure 28:
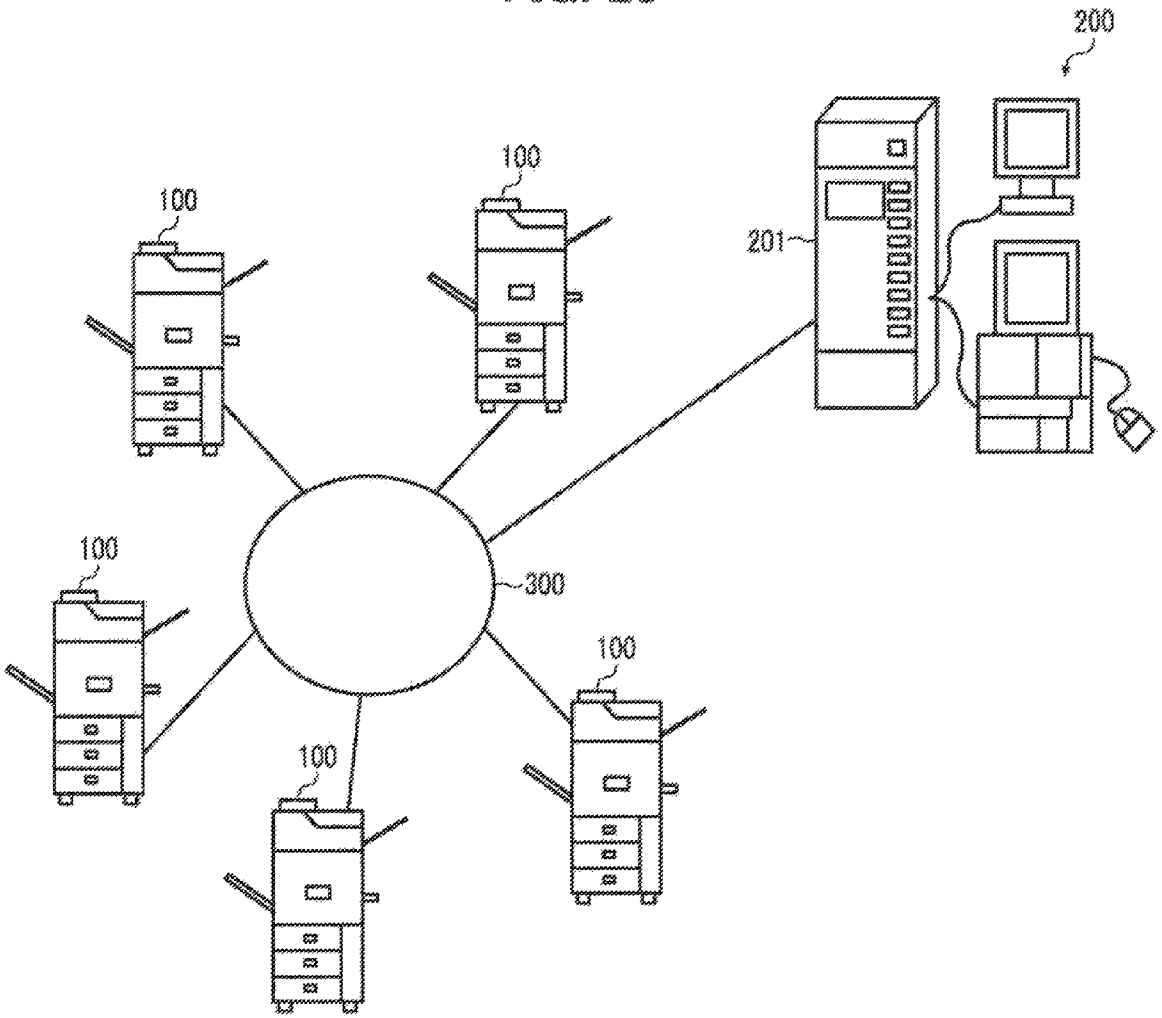
FIG. 28 is a schematic diagram illustrating an image forming system according Embodiment 2-4.

Referring to FIG. 28, in Embodiment 2-4, multiple printers 100 are connected via a network 300 to a management device 200. The management device 200 includes a memory device 201 and stores a database in which some of the multiple printers 100, conceivably installed in a similar environment, such as those sold in package deal, are grouped (correlated with each other).

Determining that the charging bias adjustment is necessary based on the photoconductor running distance and the environment, the controller 30 of the printer 100 (hereinafter "adjustment-requiring apparatus") transmits the detection result of environment (environment data), generated by the environment detector 52, to the management device 200.

In response to the detection result of environment transmitted from the controller 30 of one of the multiple printers 100, the management device 200 makes a search to determine whether there is a printer (hereinafter "adjustment-executed apparatus") that has executed the charging bias adjustment in the environment similar to the above-mentioned detection result of environment, in the same group as the adjustment-requiring apparatus (in the database).

Specifically, the management device 200 searches the memory device 201 for, e.g., a record indicating that another of the multiple printers 100 has executed the charging bias adjustment process in an environment similar to the transmitted environment data. When there is such an adjustment-executed apparatus, the management device 200 retrieves, from the memory device 201, the stored charging bias adjustment amount (included in the record), transmitted from adjustment-executed apparatus after the charging bias adjustment executed in the above-mentioned environment. The management device 200 transmits the retrieved data (i.e., adjustment data) to the adjustment-requiring apparatus. By contrast, when there is no adjustment-executed apparatus, the management device 200 transmits an execution signal to the adjustment-requiring apparatus to instruct execution of the charging bias adjustment (i.e., charging bias adjustment process including formation of background fog patterns and calculation of charging bias adjustment amount).

In the case where the management device 200 transmits the adjustment data (stored charging bias adjustment amount), the adjustment-requiring apparatus (which has transmitted the detection result of environment) adjusts the charging bias Vc by the amount equivalent to the transmitted adjustment amount, instead of executing the charging bias adjustment process. By contrast, in the case where the management device 200 transmits the execution signal, the adjustment-requiring apparatus executes the charging bias adjustment process.

In such a system, it is assumed that one of the plurality of printers 100, classified in the same group, has executed the charging bias adjustment in a certain environment. In this case, when another printer 100 is exposed to a similar environment, the charging bias Vc is adjusted, without executing the charging bias adjustment process. Thus, the occurrence of downtime of that printer 100 is reduced.

Any one of the above-described operations may be performed in various other ways, for example, in an order different from the one described above. Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. An image forming apparatus comprising:
- an image bearer;
- a charging device to charge the image bearer;
- a charge power supply to supply a charging bias to the charging device;
- a developing device to supply toner to the image bearer according to a charging potential of the image bearer;
- a toner adhesion amount detector to detect an amount of toner adhering to an image transfer bearer;
- an environment detector to generate environment data; and
- a controller configured to determine whether to execute a charging bias adjustment process in which:
  - the charging device charges the image bearer to have different potentials,
  - the developing device supplies the toner to the image bearer according to the different potentials,
  - the toner adhesion amount detector detects the amount of toner adhering to the image transfer bearer, and
  - the controller adjusts the charging bias supplied from the charge power supply, wherein the controller includes a memory device to store the environment data, and wherein the controller is configured to store an adjustment amount by which the charging bias is adjusted in the charging bias adjustment process, and when the stored adjustment amount exceeds a predetermined amount, the controller is configured to execute the charging bias adjustment process regardless of an environment change amount, and when the stored adjustment amount does not exceed the predetermined amount, the controller is configured to compare the environment data generated by the environment detector with previous environment data stored in the memory device, and determine not to execute the charging bias adjustment process when the environment change amount is not greater than a threshold.

2. The image forming apparatus according to claim 1, further comprising a writing device to write an electrostatic latent image on the image bearer, the writing device to write an area coverage modulation pattern for adjustment, the area coverage modulation pattern having an image area rate lower than a solid image, wherein the writing device writes the area coverage modulation pattern before and after the charging bias adjustment process, and wherein the controller is configured to set a maximum adjustment amount in the charging bias adjustment process to a value to keep a color difference not greater than a predetermined value, the color difference measured between the area coverage modulation pattern formed before the charging bias adjustment process and the area coverage modulation pattern formed after the charging bias adjustment process.

3. The image forming apparatus according to claim 2, wherein the predetermined value of the color difference is not greater than 10.

4. The image forming apparatus according to claim 2, wherein the area coverage modulation pattern includes 4th through 12th gradation levels, of 16-level gradation in which a 16th gradation level has an image area rate of 100%, and the image area rate is reduced by 6.25% from a 15th gradation level through a 1st gradation level as the gradation level decreases.

5. The image forming apparatus according to claim 2, wherein the controller is configured to modify a reproduction condition of area coverage modulation based on a detection result of the toner adhesion amount detector detecting a toner adhesion amount of each gradation level of an area coverage modulation pattern image.

6. The image forming apparatus according to claim 2, further comprising an input device to input the maximum adjustment amount to the controller.

7. The image forming apparatus according to claim 1, further comprising an operating amount detector to detect an amount by which the image bearer has been used, wherein the controller is configured not to execute the charging bias adjustment process when the amount detected by the operating amount detector is not greater than a predetermined amount, regardless of the environment change amount.

8. An image forming system comprising:

a plurality of image forming apparatuses; and a management device including a memory device, the management device to communicate with the plurality of image forming apparatuses, each of the plurality of image forming apparatuses including:

an image bearer;

a charging device to charge the image bearer;

a charge power supply to supply a charging bias to the charging device;

a developing device to supply toner to the image bearer according to a charging potential of the image bearer;

a toner adhesion amount detector to detect an amount of toner adhering to an image transfer bearer;

an environment detector to generate environment data; and a controller configured to determine whether to execute a charging bias adjustment process in which the charging device charges the image bearer to have different potentials, the developing device supplies the toner to the image bearer according to the different potentials, the toner adhesion amount detector detects the amount of toner adhering to the image transfer bearer, and the controller adjusts the charging bias supplied from the charge power supply, wherein the controller includes a memory device to store the environment data, and wherein the controller is configured to store an adjustment amount by which the charging bias is adjusted in the charging bias adjustment process, and when the stored adjustment amount exceeds a predetermined amount, the controller is configured to execute the charging bias adjustment process regardless of an environment change amount, and when the stored adjustment amount does not exceed the predetermined amount, the controller is configured to compare the environment data generated by the environment detector with previous environment data stored in the memory device of the controller, and determine not to execute the charging bias adjustment process when the environment change amount is not greater than a threshold.

9. The image forming system according to claim 8, wherein the controller is configured to:

transmit the environment data to the management device when the controller determines that the charging bias requires adjustment;

adjust the charging bias based on adjustment data when the adjustment data is transmitted from the management device after transmission of the environment data; and execute the charging bias adjustment process and transmit, to the management device, the adjustment amount of the charging bias in the charging bias adjustment process, and wherein the management device is configured to:

store, in the memory device of the management device, the adjustment amount transmitted from the controller;

in response to the environment data transmitted from one of the plurality of image forming apparatuses, search the memory device of the management device for a record indicating that another of the plurality of image forming apparatuses has executed the charging bias adjustment process in an environment similar to the transmitted environment data; and transmit the adjustment amount in the record, as the adjustment data, to the one of the plurality of image forming apparatuses.

* * * * *